US011764450B2

(12) United States Patent
Rahiminejad et al.

(10) Patent No.: US 11,764,450 B2
(45) Date of Patent: Sep. 19, 2023

(54) LOW LOSS MICROELECTROMECHANICAL SYSTEM (MEMS) PHASE SHIFTER

(71) Applicant: California Institute of Technology, Pasadena, CA (US)

(72) Inventors: Sofia Rahiminejad, Pasadena, CA (US); Maria A. Del Pino, Pasadena, CA (US); Cecile D. Jung-Kubiak, Pasadena, CA (US); Theodore J. Reck, Pasadena, CA (US); Goutam Chattopadhyay, Pasadena, CA (US)

(73) Assignee: California Institute of Technology, Pasadena, CA (US)

( * ) Notice: Subject to any disclaimer, the term of this patent is extended or adjusted under 35 U.S.C. 154(b) by 133 days.

(21) Appl. No.: 16/922,719

(22) Filed: Jul. 7, 2020

(65) Prior Publication Data

US 2021/0013569 A1 Jan. 14, 2021

Related U.S. Application Data

(60) Provisional application No. 62/871,577, filed on Jul. 8, 2019.

(51) Int. Cl.

| | |
|---|---|
| ***H01P 1/18*** | (2006.01) |
| ***H01Q 3/38*** | (2006.01) |
| ***H01P 11/00*** | (2006.01) |

(52) U.S. Cl.

CPC ..... *H01P 1/182* (2013.01); *H01P 11/002* (2013.01); *H01Q 3/38* (2013.01)

(58) Field of Classification Search

CPC ..... H01P 1/182; H01P 11/002; H01Q 3/38

See application file for complete search history.

(56) References Cited

U.S. PATENT DOCUMENTS

| | | | | |
|---|---|---|---|---|
| 6,441,700 | B2 * | 8/2002 | Xu | H01P 1/184 333/161 |
| 7,504,921 | B2 * | 3/2009 | Vranish | H02K 15/00 335/214 |
| 8,076,997 | B2 * | 12/2011 | Bertin | H01P 1/182 333/248 |
| 9,196,940 | B2 * | 11/2015 | Brown | H01P 1/182 |
| 2002/0101300 | A1 * | 8/2002 | Kudrle | H01P 1/18 333/156 |
| 2015/0372361 | A1 * | 12/2015 | Abdellatif | H01P 1/184 333/135 |

OTHER PUBLICATIONS

Barker, S., et al., "Distributed MEMS True-Time Delay Phase Shifters and Wide-Band Switches", IEEE Transactions on Microwave Theory and Techniques, Nov. 1998, pp. 1881-1890, vol. 46, No. 11.

(Continued)

*Primary Examiner* — Hafizur Rahman
*Assistant Examiner* — Kimberly E Glenn
(74) *Attorney, Agent, or Firm* — Gates & Cooper LLP

(57) ABSTRACT

A phase shifter comprising an actuator coupled to a dielectric. When the dielectric is inserted into the waveguide in response to actuation by the actuator, the phase velocity of the incoming electromagnetic wave is decreased, resulting in a phase shift of the electromagnetic wave. A desired phase shift and a low insertion loss can be controlled by positioning of the dielectric and engineering the permittivity of the dielectric.

21 Claims, 21 Drawing Sheets

(56) References Cited

OTHER PUBLICATIONS

Hayden, J., et al., "2-Bit MEMS Distributed X-Band Phase Shifters", IEEE Microwave and Guided Wave Letters, Dec. 2000, pp. 540-542, vol. 10, No. 12.
Lampen, J., et al., "IEEE International Symposium on Phased Array Systems and Technology", 2010, pp. 219-224.
Bakri-Kassem, M., et al., "Novel Millimeter-Wave Slow-Wave Phase Shiftern Using MEMS Technology", Proceedings of the 6th European Microwave Integrated Circuits Conference, Jan. 2011, pp. 1-4.
Jost, M., et al., "Tunable dielectric delay line phase shifter based on liquid crystal technology for a SPDT in a radiometer calibration scheme at 100 GHz", 2016 IEEE MTT-S International Microwave Symposium (IMS). San Francisco: IEEE, May 2016, pp. 1-4.
Shah, U., et al., "Submillimeter-Wave 3.3-bit RF MEMS Phase Shifter Integrated in Micromachined Waveguide", IEEE Transactions on Terahertz Science and Technology, 2016, pp. 1-11.
Reck, T., et al., "A 700-GHz MEMS Waveguide Switch", IEEE Transactions on Terahertz Science and Technology, Jul. 2016, pp. 641-643, vol. 6, No. 4.
Grade, J.D., et al., "Design of Large Deflection Electrostatic Actuators", Journal of Microelectromechanical Systems, Jun. 2003, pp. 335-343, vol. 12, No. 3.

* cited by examiner

LOW LOSS MICROELECTROMECHANICAL SYSTEM (MEMS) PHASE SHIFTER

CROSS REFERENCE TO RELATED APPLICATIONS

This application claims the benefit under 35 USC 119(e) of commonly assigned U.S. Provisional Patent Application Ser. No. 62/871,577, filed Jul. 8, 2019, by Sofia Rahiminejad, et. al., entitled "Non-Contact Mems Rotating Waveguide Switch for Submillimeter-Wave Frequencies," which application is incorporated by reference herein.

STATEMENT REGARDING FEDERALLY SPONSORED RESEARCH AND DEVELOPMENT

This invention was made with government support under Grant No. 80NM0018D004 awarded by NASA (JPL). The government has certain rights in the invention.

BACKGROUND OF THE INVENTION

1. Field of the Invention

The present disclosure relates to phase shifters and methods of making the same.

2. Description of the Related Art

Submillimeter spectrometer and radiometer instruments provide essential information for remotely studying atmospheric composition and for measuring the surface properties of cold planetary and cometary bodies. Submillimeter-wave radars are currently being developed to measure a variety of new science objectives such as cold ice and comet particle density and velocities. At 557 GHz, the water line is several orders of magnitude stronger than at lower frequencies, thus increasing the chances to detect water on cold bodies. Unfortunately, at the moment, all instruments at these frequencies require mechanical scanning or re-orientation of the spacecraft to map a surface. By implementing electronic steering, areas can be mapped without physically moving the spacecraft, reducing mapping times as well as the mass and power of the instrument. A phased array antenna with integrated phase shifters can be used to steer the main beam electronically.

Electronic beam scanning antenna systems do not currently exist at submillimeter-wave frequencies because of the non-availability of reliable, low-loss continuously tunable phase shifters at these frequencies. Current commercial phase shifters utilizing integrated circuit technologies such as SiGe, p-i-n diode, MESFET, GaAs and CMOS phase shifters cannot operate above 200 GHz without considerable loss. At higher frequencies such as 550 GHz, rectangular waveguides are used instead of integrated circuit technologies due to their low losses. There is a need for phase shifters that are waveguide compatible and operating at higher frequencies. By integrating MEMS technology with rectangular waveguides, low loss high frequency phase shifters are possible. One of the earliest MEMS phase shifters presented was a MEMS bridge placed periodically over a coplanar waveguide (CPW) transmission line operating at 60 GHz [1]. Since then there have been several MEMS phase shifters operating at lower GHz frequencies such as [2]-[4], however these phase shifters were made for planar technologies, and are not suitable for high frequency waveguide systems.

Recently a tunable waveguide phase shifter using liquid crystals showed a phase shift up to 115° at 100 GHz, however it requires an actuation voltage of 500 V and it has a return loss above 5 dB [5], making them less suitable for space applications. In [6] a waveguide MEMS phase shifter operating at 500-600 GHz, with a low-actuation voltage of 21.94 V and a phase shift of only 20° was presented. There is a need for low-loss, large phase shift, low voltage waveguide phase shifter at higher frequencies. The present disclosure satisfies this need.

SUMMARY OF THE INVENTION

The present disclosure reports on a device including a phase shifter for controlling a phase of electromagnetic field. The device can be embodied in many ways including, but not limited to, the following.

1. A device comprising the phase shifter including a dielectric material connected to an actuator. The actuator is configured to move the dielectric material into or out an electromagnetic field so that the dielectric material interacts with the electromagnetic field and shifts the phase of the electromagnetic wave associated with the electromagnetic field.

2. The device of example 1, wherein the dielectric material reduces the phase velocity of the incoming electromagnetic wave so as to shift the phase of the electromagnetic wave, and the phase shift and a low insertion loss are controlled by positioning the dielectric material and engineering the permittivity of the dielectric material.

3. The device of example 1 or 2, wherein the dielectric material comprises an electromagnetically thin slab (less than an order of magnitude, or less than 10 times smaller than, the wavelength of the electromagnetic wave) and the permittivity is engineered by implementing different hole patterns in the dielectric material.

4. The device of any of the examples 1-3, wherein the dielectric material comprises:

an input region having a first permittivity for the electromagnetic wave incident on the dielectric material through the input region;

a transmission region interfacing with the input region and having a second permittivity for the electromagnetic wave transmitted through the input region to the second region;

the second permittivity is larger than the first permittivity.

5. The device of any of the examples 1-4, wherein the dielectric material comprises:

an input region having a first permittivity tailoring an impedance match of the phase shifter to a waveguide guiding the electromagnetic wave;

a transmission region interfacing with the input region and having a second permittivity for the electromagnetic wave transmitted through the input region to the transmission region; and an output region interfacing with the transmission region, the output region tailoring an impedance match of the dielectric material to the waveguide for the electromagnetic wave transmitted from the transmission region and through the output region back to the waveguide.

6. The device of example 4 or 5, wherein the first permittivity tailors the impedance match so that more than 98% of the power of the electromagnetic wave, incident on the dielectric material from the waveguide, is transmitted and less than 2% is reflected back from the dielectric material.

7. The device of any of the preceding examples, wherein the phase shifter comprises the dielectric material and a pattern of holes in the dielectric material, the holes have a width and a spacing, and an aspect ratio comprising the width divided by the spacing is different in the input region as compared to in the transmission region.

8. The device of any of the preceding examples, further comprising:

a waveguide configured and dimensioned to guide the electromagnetic wave having a frequency in a range of 100 GHz to 1000 THz, wherein:

the first actuation moves the dielectric material into the waveguide, and the second actuation moves the dielectric material out of the waveguide.

9. The device of example 8, wherein the waveguide comprises a hollow waveguide having a rectangular cross-section and a metal surface.

10. The device of any of the preceding examples, further comprising:

a first block comprising one or more first sections of one or more waveguides;

a second block comprising one or more second sections of the one or more waveguides; and the at least one phase shifter between the first block and the second block such that each one of the first sections mates with one of the second sections to form a waveguide coupled to one of the phase shifters, the waveguide guiding the electromagnetic wave shifted by the one of the phase shifters.

11. The device of any of the preceding examples, wherein the position of the dielectric inside or relative to the waveguide, and the associated phase shift, are controlled by application of electrical signals or voltages applied to the actuator.

12. The device of any of the preceding examples 1-11, wherein the actuator comprises a micro-electromechanical system comprising a motor.

13. The device of example 10, wherein the motor comprises a comb drive.

14. The device of any of the preceding examples, further comprising:

a phased array antenna system comprising a plurality of antennas;

a plurality of the at least one actuator;

a plurality of the at least one phase shifter; and a plurality of waveguides, each of the waveguides:

feeding one of the plurality of antennas with the electromagnetic waves so as to generate electromagnetic radiation emitted from the antennas; and coupled to one of the phase shifters so that the actuator moves the one of the phase shifters into the electromagnetic wave guided by the waveguide coupled to the one of the phase shifters.

15. The device of example 14, further comprising a computer, processor, or controller controlling the actuators so as to independently move each of the phase shifters comprising different permittivities and/or by different amounts, thereby shifting the phase of the electromagnetic waves in each of the waveguides by different amounts so as to electronically steer a beam of electromagnetic radiation generated from the electromagnetic waves and outputted from the antennas. The phase shifts tailor constructive and/or destructive interference of the electromagnetic radiation so as to control directivity of the electromagnetic radiation and the phased array.

16. The device of example 15, wherein the computer controls the actuators with a digital signal so that the phase shifters digitally shift the phase of the electromagnetic waves according to the digital signal.

17. The device of example 15, wherein the computer controls the actuators with an analog signal so that the phase shifters shift the phase electromagnetic waves according to the analog signal.

18. A remote sensing system comprising the device of any of the examples 14-17, wherein the electromagnetic radiation is used to perform remote sensing. Examples include, but are not limited to, a tracking or mapping system for mapping of planetary surfaces, wind tracking, or water detection on earth or in deep space.

19. A communications system comprising the device of any of the examples 14-17, wherein the electromagnetic radiation transmits a signal.

20. A method of making a device, comprising:

providing at least one phase shifter comprising a dielectric material; and providing at least one actuator connected to the at least one phase shifter, wherein the actuator is configured to move the phase shifter into or out an electromagnetic wave so as to shift a phase of the electromagnetic wave interacting with the phase shifter.

21. The method of example 20, wherein providing the phase shifter comprises etching the dielectric material with a pattern of holes.

22. The method of examples 20 or 21, wherein providing the actuator comprises etching a micro-electromechanical system structure in a wafer.

23. The method of examples 20, 21, or 22, wherein the providing comprises:

providing a silicon wafer including a buried oxide layer;

thermally oxidizing the silicon wafer to form a first thermal oxide on a front side of the silicon wafer and second thermal oxide on a back side of the silicon wafer, under conditions to avoid thermal shock to the silicon wafer;

depositing photoresist on the first thermal oxide;

patterning the first thermal oxide with the pattern and a first side of the actuator structure, using photolithography;

etching the pattern of the holes and the first side of actuator structure in the first thermal oxide, using inductively coupled plasma etching;

patterning the second thermal oxide with a second side of the actuator structure on an area of the silicon wafer to the side of the pattern of holes;

etching the second side of the actuator structure in the wafer using inductively coupled plasma etching;

deep reactive ion etching the silicon wafer using the first thermal oxide as a first mask and a first side of the buried oxide layer as an etch stop, to define the pattern of holes and the first side of the actuator structure in the silicon wafer;

deep reactive ion etching the second side of the silicon wafer using the second thermal oxide as a mask and a second side of the buried oxide layer as an etch stop to:

define a cavity behind the pattern of holes in the backside of the silicon wafer, and define the second side of the actuator structure in the backside of the silicon wafer; and removing the first thermal oxide layer, the second thermal oxide layer, and the exposed buried oxide layer so that the actuator structure comprising an arm connected to the pattern of holes can move.

24. The method of any of the examples 20-23, further comprising:

machining a first block (e.g., comprising metal) so as to form a first section of a waveguide in the first metal block;

machining a second block (e.g., comprising metal) so as to form a second section of the waveguide in the second block; and assembling the phase shifter between the first block and the second block so as to form the waveguide comprising the first section mating with the second section and the phase shifter coupled to the phase shifter, the waveguide guiding the electromagnetic wave shifted by the one of the phase shifters.

25. The device or method of any of the preceding examples, wherein the dielectric material comprises or consists essentially of silicon or a semiconductor material.

26. The device or method of any of the preceding examples, wherein the phase shifter comprises an analog silicon MEMS phase shifter operating between 500-600 GHz. The MEMS phase shifter is based on the dielectric loading of a metallic waveguide by inserting a silicon slab with an engineered dielectric constant. The phase shifter consists of a 30 μm thick perforated silicon slab that is moved in and out of a waveguide in the E-plane with a large deflection MEMS actuator. By implementing different hexagonal patterns in the silicon slab, a stepped permittivity is created to reduce return loss. The MEMS phase shifter is fully actuated at around 50 V for both directions, and can move up to 95 μm, depending on the applied voltage. The insertion loss, when the maximum phase shift is achieved, is measured to be 1.8 dB, compared to a 1.6 dB insertion loss for a waveguide of equivalent length. The return loss is better than 18 dB for the desired band. The measured phase shift, with the slab fully inserted into the waveguide at 550 GHz was 145°. The phase shift is stable across the band with a maximum change of 21° across the entire band. The phase shifter was actuated 10 million cycles without any fractions to the beams. The phase shifter also shows a durability after 10 million cycles with a slight degradation in spring performance.

BRIEF DESCRIPTION OF THE DRAWINGS

Referring now to the drawings in which like reference numbers represent corresponding parts throughout.

DETAILED DESCRIPTION OF THE INVENTION

In the following description of the preferred embodiment, reference is made to the accompanying drawings which form a part hereof, and in which is shown by way of illustration a specific embodiment in which the invention may be practiced. It is to be understood that other embodiments may be utilized and structural changes may be made without departing from the scope of the present invention.

Technical Description

I. EXAMPLE DESIGN AND SIMULATION

Figure 1:
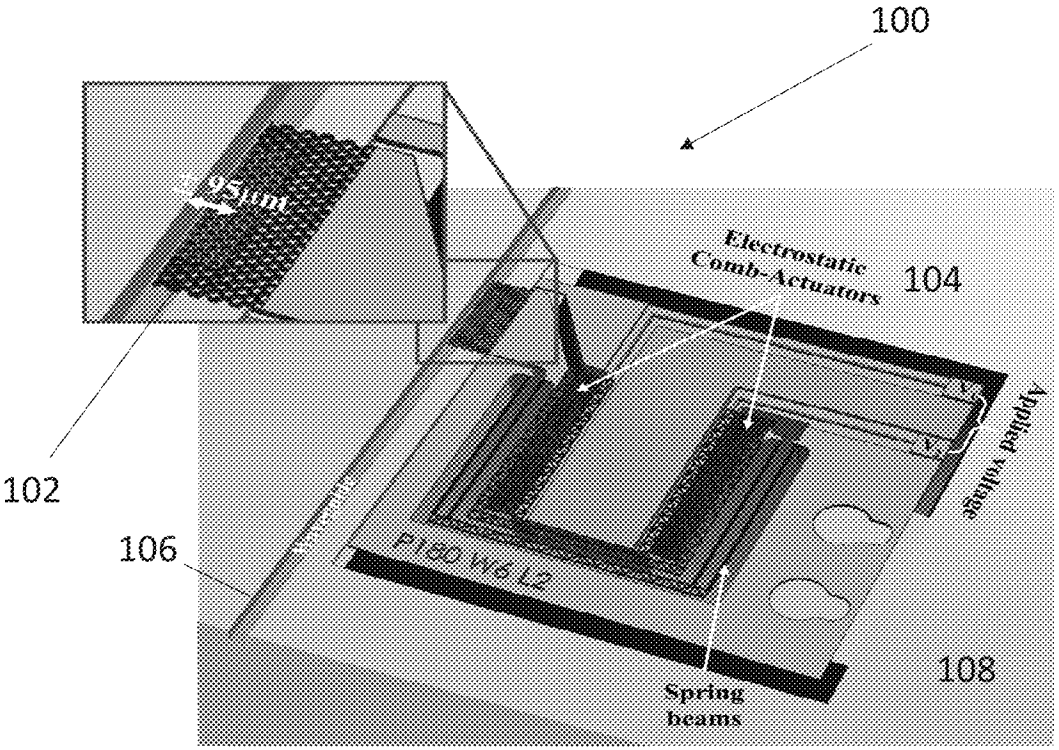
FIG. 1: Illustration of the MEMS phase shifter placed inside the metal block, the waveguide is part of the metal block. By actuating the device, the silicon slab can be moved in and out of the waveguide, thereby inducing different phase shifts.

FIG. 1 is an illustration of a MEMS phase shifter 100 according to one example, comprising a dielectric material 102 (e.g., dielectric slab comprising silicon) and an actuator 104 connected to the phase shifter 100. In the example shown, the phase shifter comprises a large deflection MEMS actuator with dual combs. The MEMS actuator 104 is used to move the dielectric slab 102 back and forth inside and outside the waveguide 106. By using dual combs, twice the actuation distance can be achieved while avoiding side collapse. The phase shifter is placed into a metal block 108. The waveguide 106 is milled into the metal block so that the dielectric slab can move in and out of the waveguide when actuated by MEMS actuator 104.

A. Dielectric Slab

The phase shifter concept is based on loading a rectangular metallic waveguide with a thin dielectric slab in the center of the E-plane of the waveguide. As a result, the phase velocity of incoming electromagnetic waves is slowed down so as to achieve a phase shift. The magnitude of the phase shift depends on the permittivity of the slab and how much of the waveguide volume the slab occupies. A high permittivity slab will create a large phase shift for a small volume. In one or more example applications, the object is to achieve a large angle analog phase shifter with a high phase shift resolution and low insertion loss. In one or more such example applications, the key is implementing a silicon slab occupying as little as possible of the waveguide length.

The design challenge is the optimization is based on these two opposing requirements:

(1) silicon has a high dielectric constant and that creates severe impedance mismatch; and (2) on the other hand, a high dielectric constant is needed to achieve large phase shift.

Figure 2:
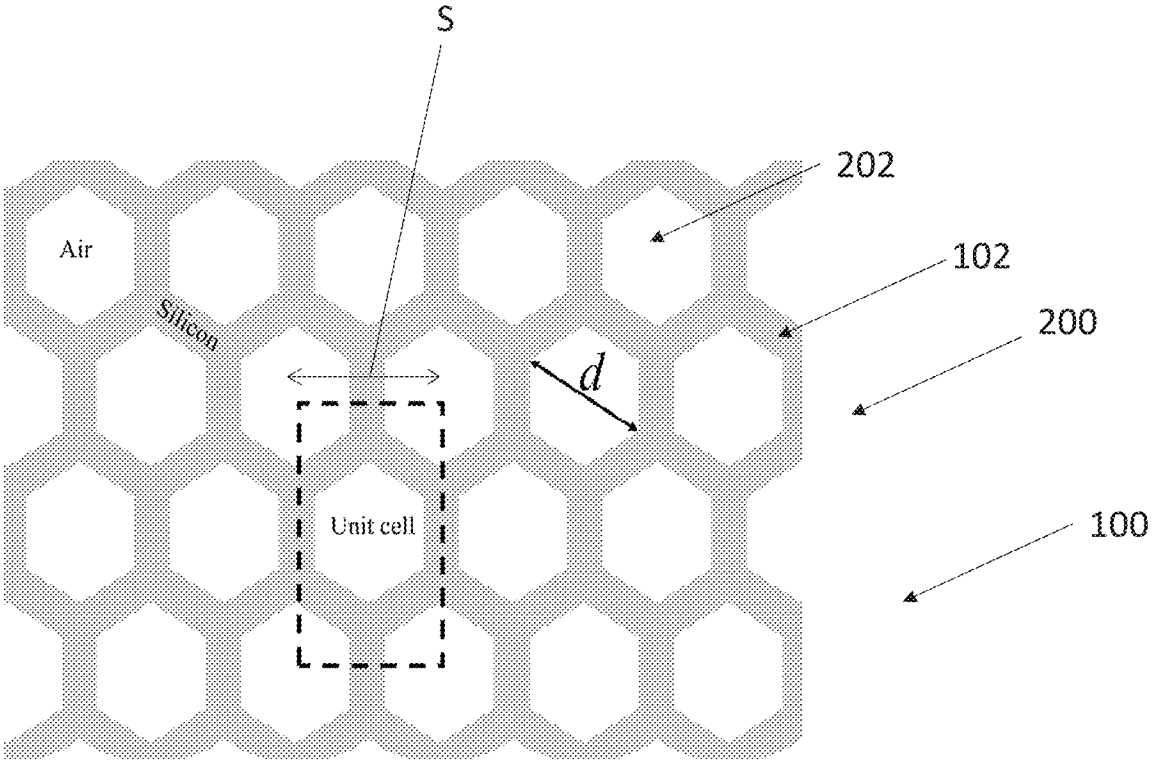
FIG. 2: Perforated silicon slab with hexagonal holes

Surprisingly and unexpectedly, we have been able to accommodate these opposing requirements and tailor a suitable artificial dielectric constant with silicon by perforating the slab in a controlled way, as can be seen in FIG. 2. FIG. 2 shows the phase shifter comprises the dielectric material and a pattern 200 of holes 202 (comprising air) in the dielectric material, wherein the holes have a width d and a spacing S. Depending on the silicon-to-air ratio of a unit cell (illustrated in FIG. 2), different permittivities can be achieved between the relative permittivity of air ($\varepsilon_r$=1) and the relative permittivity of silicon ($\varepsilon_r$=11.9). In our simulations, we define the aspect ratio as the ratio of the width d of the hexagonal hole to the unit cell size S (as shown in FIG. 2). The thickness of the perforated silicon slab also affects the impedance matching. The thickness was therefore chosen to be 30 μm to reduce the reflection coefficient, while still having a structurally sound silicon slab and actuator.

Figure 3:
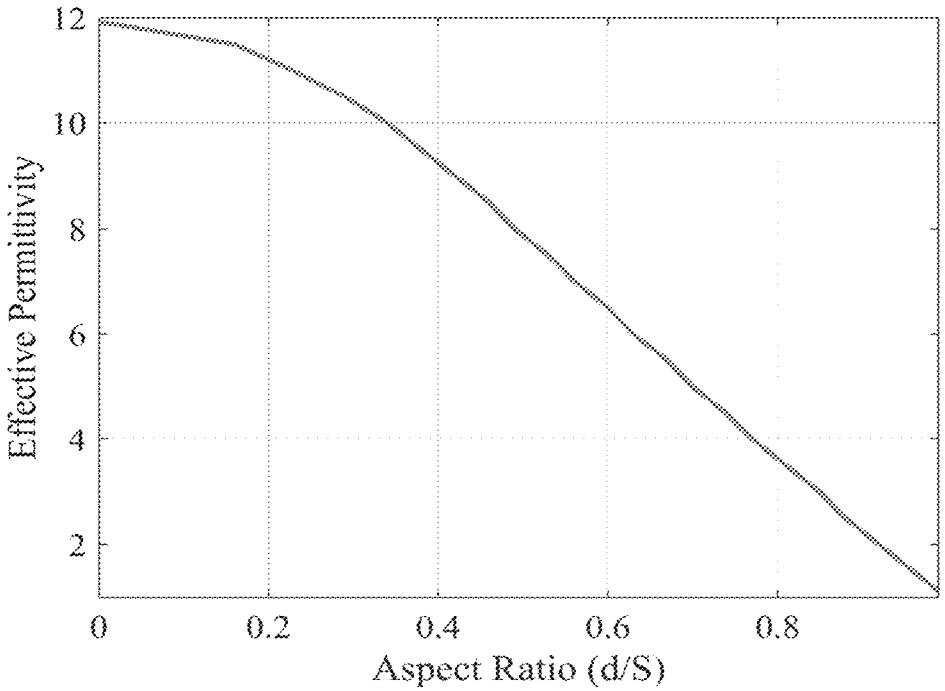
FIG. 3: The effective permittivity depends on the aspect ratio between long diagonal diameter of the hexagon and width of the unit cell marked in FIG. 2

FIG. 3 shows the extracted effective permittivity of the silicon slab when inserted into the waveguide, obtained by comparing the S11 and S12 of a solid slab (with relative permittivities between 1 and 11.9) to a silicon slab with hexagonal holes of different aspect ratios. The RMS (root mean square) of the difference between each permittivity and aspect ratio was calculated and the lines with the lowest RMS value were matched. Thus, FIG. 3 illustrates the relationship between the aspect ratio of the hexagonal pattern and the corresponding relative permittivity.

The relative permittivity and length of the slab determines the amount of phase shift that can be achieved when inserted into the waveguide. Simulations show that a large relative permittivity will give a large phase shift for a short length, however the slope of the phase shift as a function of frequency will also be larger. Therefore, a lower relative permittivity of $\varepsilon_r$=4.5 was chosen, with a length of 0.68 mm, to have a smaller slope over the frequency band.

Figures 4A, 4B:
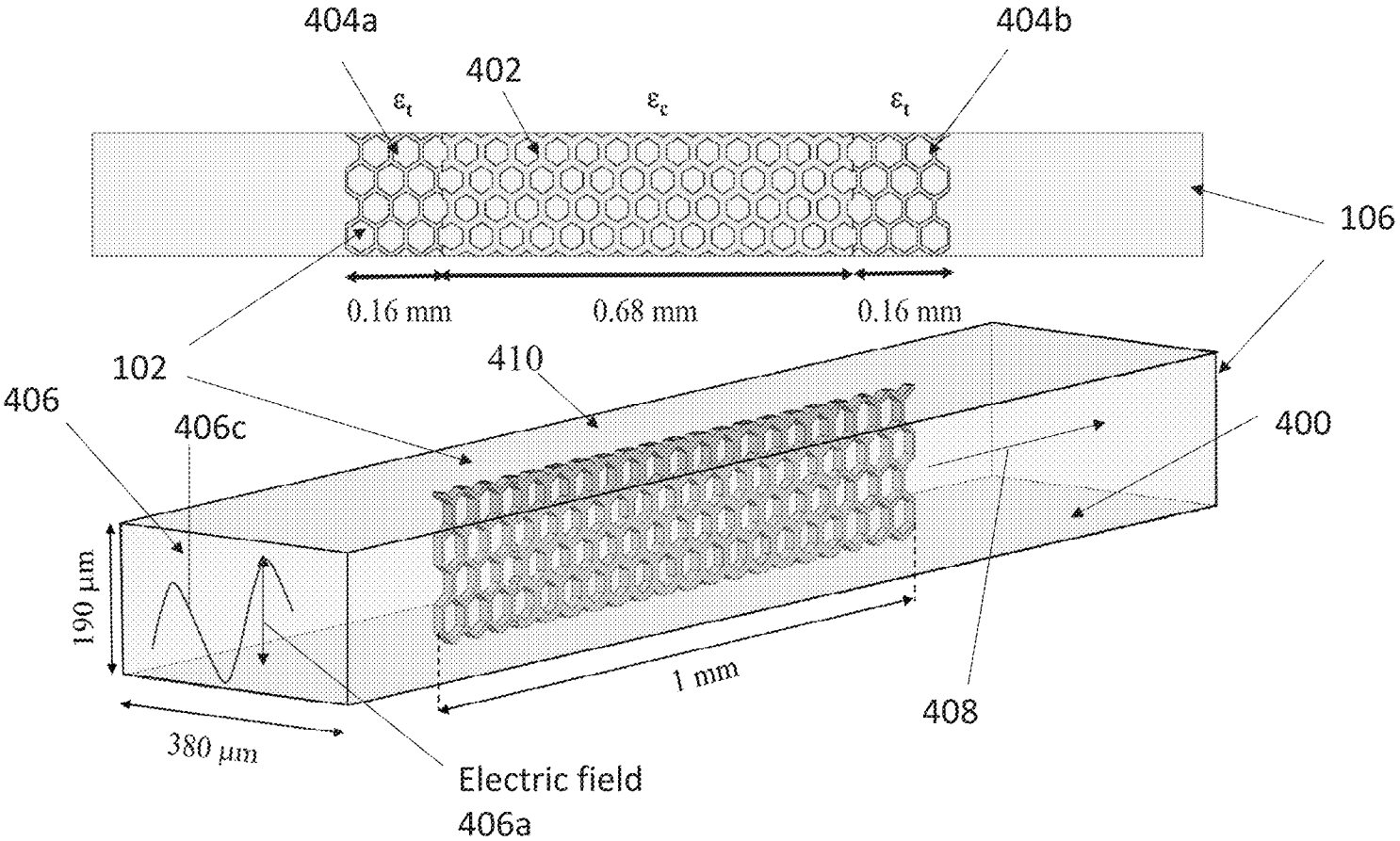
FIG. 4A: A first view of the perforated silicon slab inserted into the waveguide in the E-plane.
FIG. 4B: Second view of the perforated silicon slab inserted into the waveguide.

FIGS. 4A and 4B illustrate the waveguide 106 coupled to the phase shifter 100. The waveguide 106 comprises a hollow waveguide (containing air) having a rectangular cross-section and a conductive (e.g., metal) surface 400. FIG. 4A illustrates the dielectric comprises a quarter-wave impedance matched transition dielectric et on both sides of the center dielectric 404 to avoid strong reflections. In one or more examples, the dielectric material 102 comprises an intermediate region 402 having dielectric permittivity cc between input region 404*a* having dielectric permittivity ea and output region 404*b* having dielectric permittivity $\varepsilon_{r2}$ (in one or more examples, the system is symmetric and the input and output can be reversed). By extracting the impedance of the center slab 402, the permittivity of the transition dielectric $\varepsilon_t$ could be determined ($\varepsilon_t$=2.7). The length of the transition dielectric $\varepsilon_t$ in the example shown is roughly λg/4~0.16 mm. FIG. 4B further illustrates an example electric field 406*a* component of the electromagnetic field 406 or wave 406*c* interacting the dielectric material so that a phase Φ of the electromagnetic wave 406*c* is shifted by a desired amount. The electromagnetic wave 406*c* propagates in a direction 408 along a longitudinal axis of the waveguide 106. The waveguide 106 includes an opening 410 through which the dielectric material 102 enters or exits into the waveguide 106 in response to the actuation by the actuator.

Figure 5:
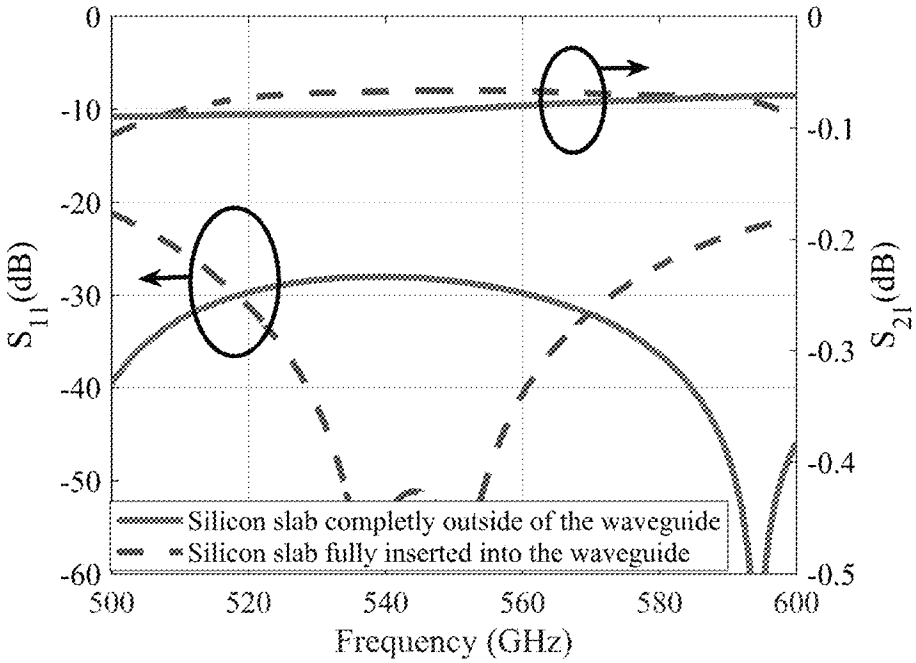
FIG. 5: S12 and S11, when the slab is fully inserted (red dashed line), and when the slab is completely extracted from the waveguide, leaving it empty (blue solid line).
Figure 6:
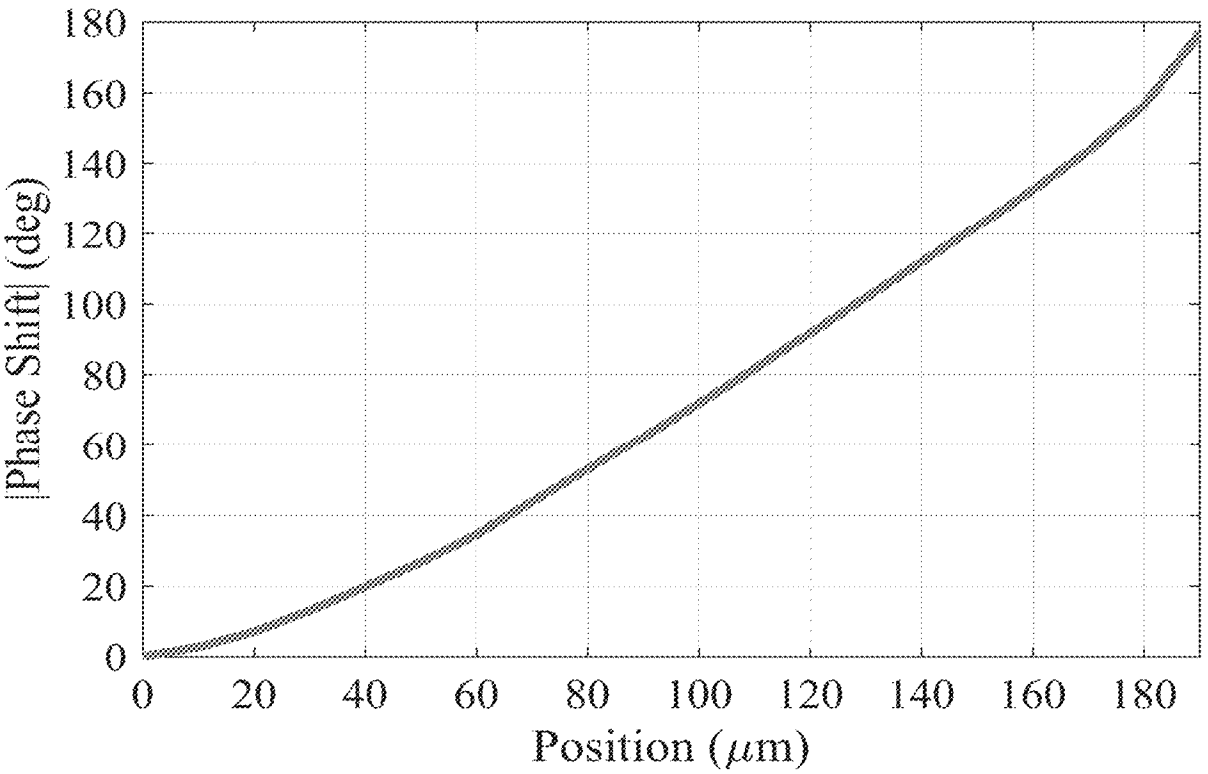
FIG. 6: Simulated magnitude of the phase shift at 550 GHz depending on the position inside the waveguide (at 0 μm the waveguide is empty, at 190 μm the silicon slab is fully inserted into the waveguide).

FIG. 5 shows the simulated S11 and S21 for when the slab was fully inserted into the waveguide and when the slab is completely extracted from the waveguide. FIG. 6 illustrates the simulated magnitude of the phase shift (depending on how far the slab was inserted into the waveguide). The designed phase shifter can achieve a phase shift having a maximum magnitude of 177° at 550 GHz.

B. MEMS Actuator

A large-deflection MEMS actuator is used to move the silicon slab in and out of the waveguide. In this example, the MEMS actuator is based on the actuator presented in [7], [8].

Figure 7:
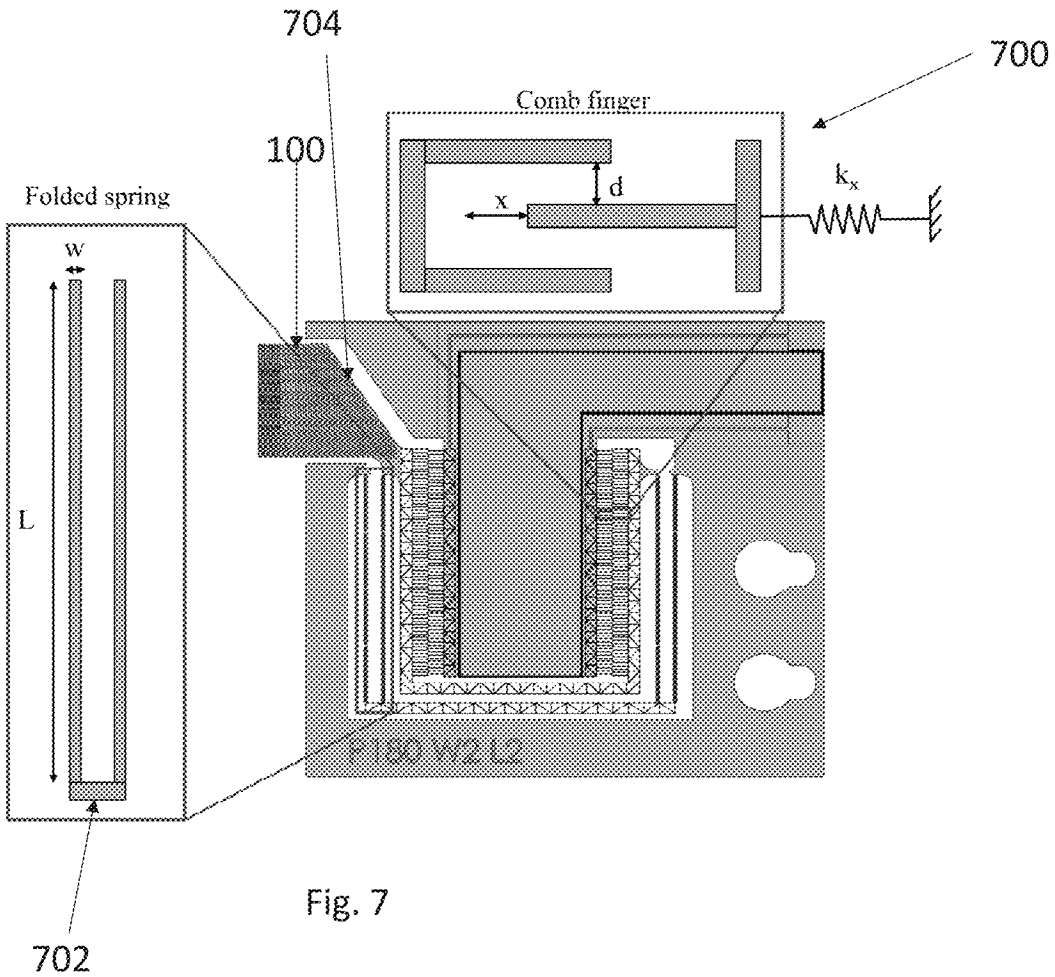
FIG. 7: Close-up of the comb-drive finger and spring beam.

The actuator is an electrostatically driven comb-drive that uses two folded spring beams to move the dielectric slab back and forth. By applying a voltage over the fingers in the comb-drive, the fingers will be attracted towards each other by capacitive forces. FIG. 7 shows the comb of fingers is attached to a folded spring in the shape of a long silicon beam. The spring constant in the moving direction for two parallel folded beams $k_x$ of the slab is expressed as $$k_x = \frac{Ew^3t}{L^3} \tag{1}$$

where E is the Young's modulus of silicon ($1.69\times10^{11}$ Pa), w is the width of the beam (4 μm), t is the thickness (30 μm) and L is the length of one beam (1.8 mm).

To move the actuator x μm, a force $F=k_x x$ is needed. The force applied by the comb-drive can be expressed as $$F = \frac{V^2 n\epsilon t}{d} \quad (2)$$

where V is the applied voltage, n is the number of fingers (65), ε is the permittivity between the fingers, in our case only air ($\varepsilon r\varepsilon_0 = 8.85\times10^{-12}$) and d is the distance between the fingers (10 μm). To determine what voltage is needed to move the actuator x μm eq. 1 and eq. 2 can be combined into $$V = \sqrt{\frac{dk_x x}{n\epsilon t}} \quad (3)$$

Figure 8A:
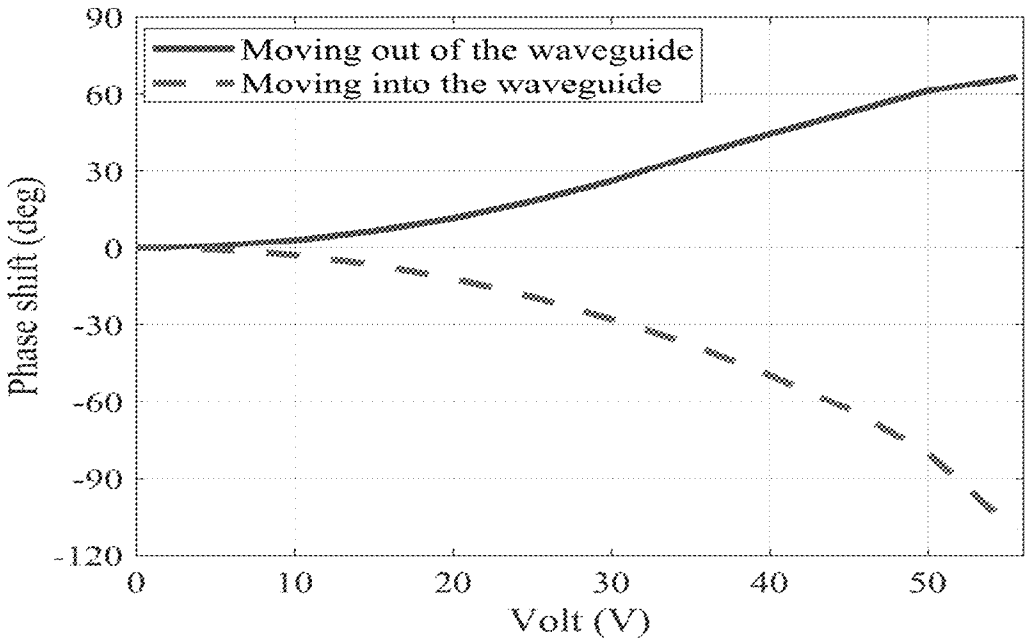
FIG. 8A: a) The simulated phase shift at 550 GHz imposed by the silicon slab inside the waveguide, depending on the applied voltage. The red dashed line shows the phase shift depending on the voltage of the silicon slab when moving into the waveguide. The blue solid line shows the phase shift depending on the voltage of the silicon slab when moving out of the waveguide.
Figure 8B:
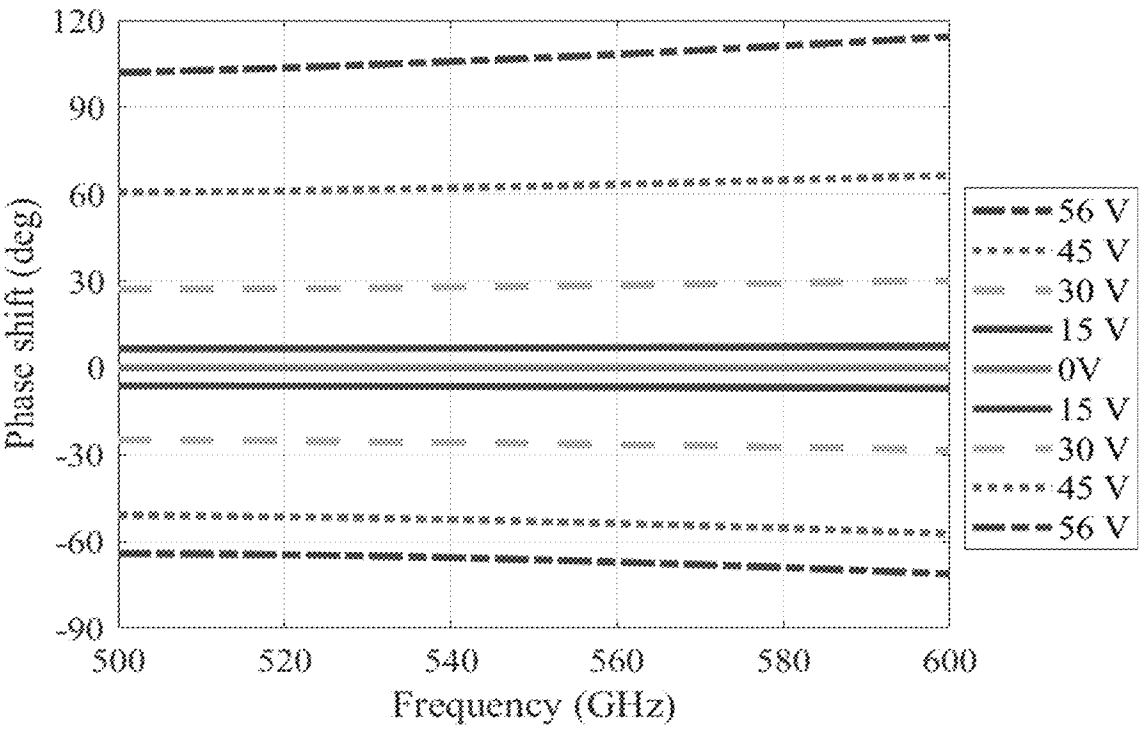
FIG. 8B: Simulated phase shifts for different applied voltages over the frequency band 500 600 GHz. The positive values corresponds to when the slab is moving out of the waveguide and the negative values corresponds to when the slab is moving into the waveguide.

Eq. 3 together with the results in FIG. 6 gives the relationship between the applied voltage and the imposed phase shift, as shown in FIG. 8B.

The motor was designed to move up to 100 μm. To move the full 100 μm, according to simulations done with ABAQUS together with eq. 3, an applied voltage of about 56 V is required. The waveguide height is 190 μm, thus leaving a margin of 5 μm for alignment.

C. Fabrication

The MEMS phase shifter is made out of high resistivity silicon to have low insertion loss. Since the permittivity can be engineered with a hexagonal hole pattern (FIG. 2 and FIG. 3), no other deposited materials were needed, except for thermal oxide (TOX) which is used as a sacrificial hard mask for deep reactive ion etch (DRIE). Hard masks are thin patterned layers of metal, insulators or polymers that have an increased selectivity to silicon (as compared to photoresist) during DRIE, and are used to define the silicon patterns.

A 4" Silicon-On-Insulator (SOI) wafer 900 with a device thickness of 30 μm and a handle thickness of 350 μm was used. The MEMS actuator is defined in the 30 μm thick device layer. The buried oxide (BOX) 902 acts as a stop layer so that during etching, the height of the MEMS actuator will be uniform throughout the wafer.

Figure 9:
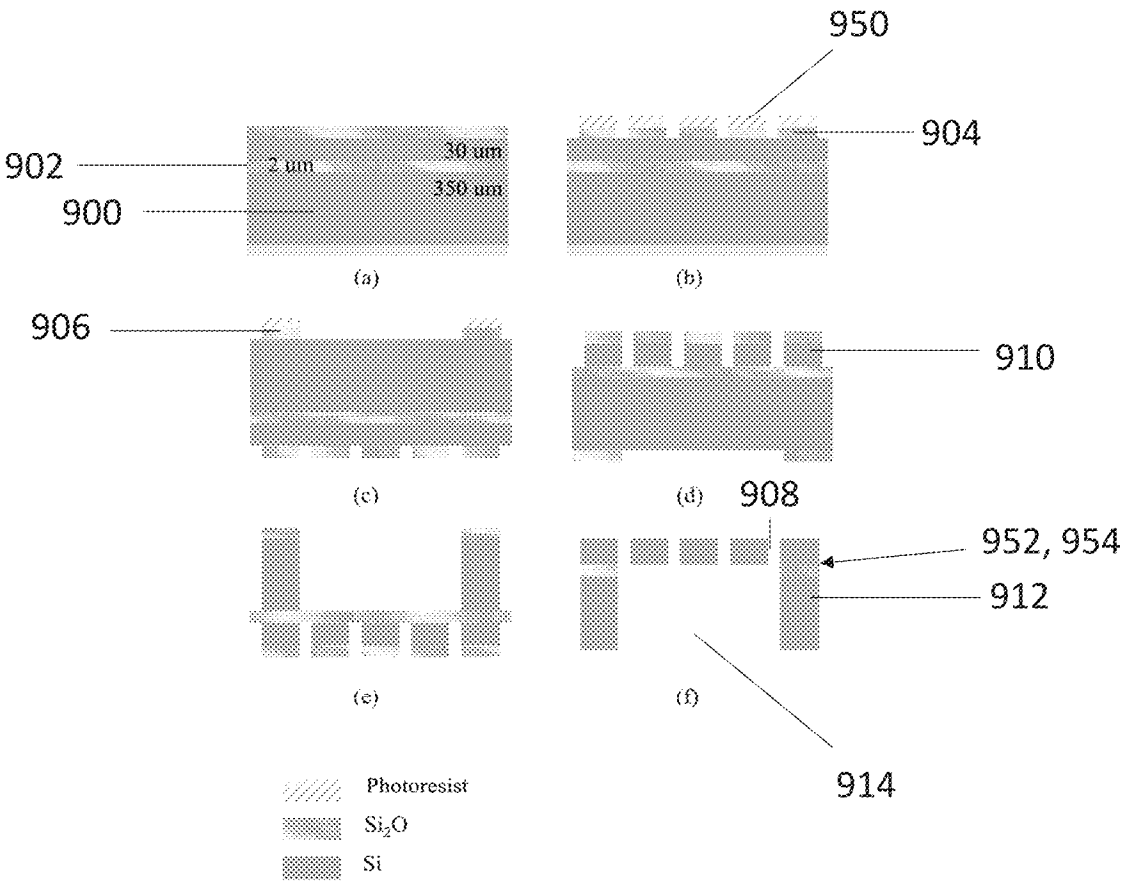
FIG. 9: Process flow for the Si MEMS phase shifter. a) SOI wafer (30 μm/2 μm/350 μm) with 3 μm TOX. b) Front side of the wafer is patterned. c) The wafer is flipped upside down and the back side of the wafer is patterned. d) The front side of the wafer is etched with DRIE. e) The back side of the wafer is etched with DRIE. f) The BOX is removed from the back using dry etching, the remaining TOX on the front is also removed

The process flow is shown in FIG. 9 and the detailed fabrication steps are described as follows.

1) A thermal oxidation (TOX) step is performed in an oxidation furnace at 1050° C., using water vapor, FIG. 9*a*. The TOX will be used as a hard mask when patterning the front and back of the wafer 900. The wafer is inserted in the furnace at 300° C. and the temperature is ramped up to 1050° C. The temperature was then held at 1050° C. for 24 hours, to achieve a TOX thickness of roughly 3 μm. The oxidation oven was then cooled down to below 800° C., and the wafer was removed from the oven. The ramping was done to avoid any thermal shock to the wafer. First thermal oxide 904 and second thermal oxide 906 are formed 2) The front side TOX was patterned using ultraviolet (UV) photolithography and the photoresist AZ5214. The photoresist pattern was then transferred to the thermal oxide using a fluorine based inductive coupled plasma, to define the dielectric slab (comprising holes 908) and actuator patterns (comprising structures 910), as shown in FIG. 9*b*.

3) The wafer is then flipped and the backside of the wafer is patterned in the same way as in the previous step, FIG. 9*c*.

4) The wafer is then flipped again and the 30 μm thick device layer is etched with Deep Reactive Ion Etching (DRIE) until the BOX is exposed across the entire wafer, FIG. 9*d*.

5) Large cavities 914 behind the MEMS actuator are etched with DRIE on the backside of the wafer so that the backside BOX can easily be removed and the MEMS actuator and slab can move freely. The 3 μm thick oxide mask is thick enough to withstand the DRIE process to etch 350 μm of silicon down to the BOX, FIG. 9*e*.

6) The TOX is removed with inductively coupled plasma (ICP) etching from the front side of the wafer to be able to have ohmic contact with the actuators. The BOX was removed from the back to release the actuator arms and fingers, so that the MEMS actuator can move freely, FIG. 9*f*.

Figure 10:
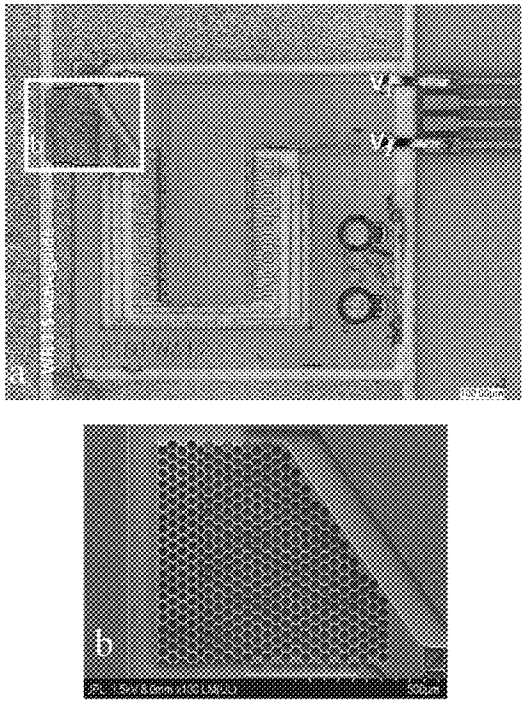
FIG. 10: a) Microscope image of the MEMS phase shifter, mounted into the measurement block. b) SEM image of the silicon perforated slab before release from the handle wafer.

FIG. 10*a* shows the fabricated MEMS phase shifter mounted into the measurement block and FIG. 10*b* shows an SEM image of the slab before it is released.

D. Assembly, Characterization, and Discussion

Two sets of measurements were performed to evaluate the MEMS phase shifter. Evaluation of the electromagnetic performance of the fabricated phase shifter inside the waveguide block is discussed in section D-2. Evaluation of the electromechanical performance of the phase shifter is discussed in section D-2.

1. Assembly

The MEMS device was placed inside a gold plated computer numerical control (CNC) milled brass block. Since the actuator is designed to move 100 μm and the height of the waveguide is 190 μm (FIG. 4), the edge of the silicon slab needs to be aligned to be placed in the center of the waveguide with a precision of +/−5 μm, such that the silicon slab can be fully inserted into the waveguide and fully excited. A rough alignment of the MEMS comprises first pushing the slab with 2-5 μm needle probe tips in the x-direction until it is aligned with the brass wall, then in the y-direction so that the silicon slab is centrally aligned in the slab slot (seen inside the square of FIG. 10*a*). The needle probe tips were used to do a finer alignment to obtain the +/−5 μm required precision.

After the alignment, the needle probes were used to press down and secure the MEMS chip while cyanoacrylate was applied. When the cyanoacrylate had dried, the needle probes were removed and $H_20E$ (silver epoxy flakes) was applied to fully secure the MEMS device. The silver epoxy was then cured for 1 hour at 120° C.

2. Submillimeter-Wave Characterization

Figure 11A:
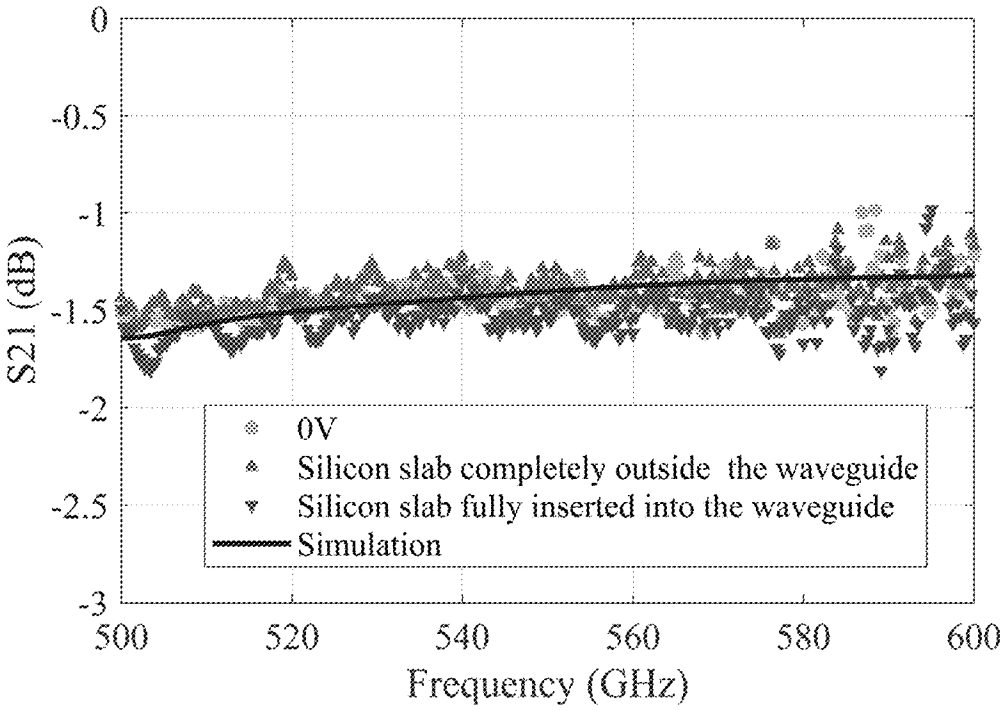
FIG. 11A-11B: Measured and simulated S-parameters S21 (FIG. 11A) and S11 (FIG. 11B). Measured when the slab is fully inserted (blue down pointing arrows), when the slab is completely extracted from the waveguide leaving it empty (red up pointing arrows), and when in neutral position at 0V. The black solid lined was simulated when the slab was fully inserted in the waveguide.
Figure 11B:
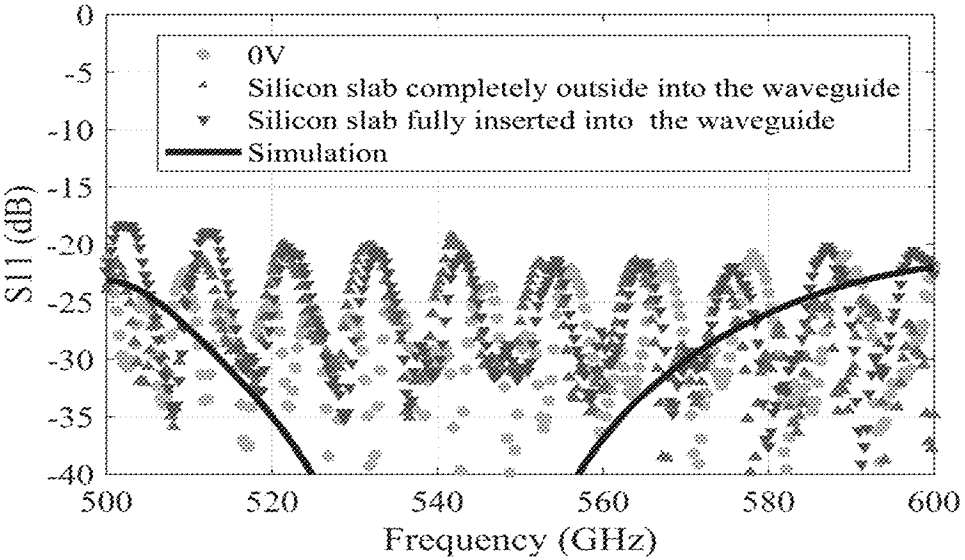

The S-parameters of the fabricated MEMS phase shifter were measured with an Agilent PNAX system using VDI WR-1.5 VNA extenders. FIG. 11 shows the measured insertion loss (FIG. 11A) and the return loss (FIG. 11B) for three states of the MEMS phase shifter. The silicon slab is located half-way across the waveguide in the passive position (0 V applied). When fully actuating V1 with ground the silicon slab was moved completely outside the waveguide, when fully actuating V2 with ground (FIG. 1 and FIG. 10*a*), the silicon slab was fully inserted into the waveguide.

The insertion loss of these three states was measured to be lower than 1.8 dB. The large difference compared to the simulated insertion loss in FIG. 5 is mostly due to the added waveguide length of the gold-plated brass block. FIG. 11 also shows the simulated loss of the phase shifter fully inserted into the 20 mm long gold plated waveguide in the block can be seen together with measurements in FIG. 11A-FIG. 11B.

The simulations were performed for a 20 mm long conductive waveguide. The conductivity was set to $3\times10^7$ Siemens/meter to adjust for surface roughness effects at these high frequencies. The simulated insertion loss was below 1.6 dB (FIG. 11A) and the simulated return loss was above 22 dB (FIG. 11A) throughout the desired frequency band. The simulations were performed for the case when the silicon slab was completely inserted into the waveguide.

The measured return loss was larger than 18 dB for the entire band. As seen in FIGS. 11A and B, the blue up-pointing arrows shows the S-parameters for the block without the silicon slab, showing very little difference between the losses caused by the silicon slab itself and the waveguide losses.

Figure 12:
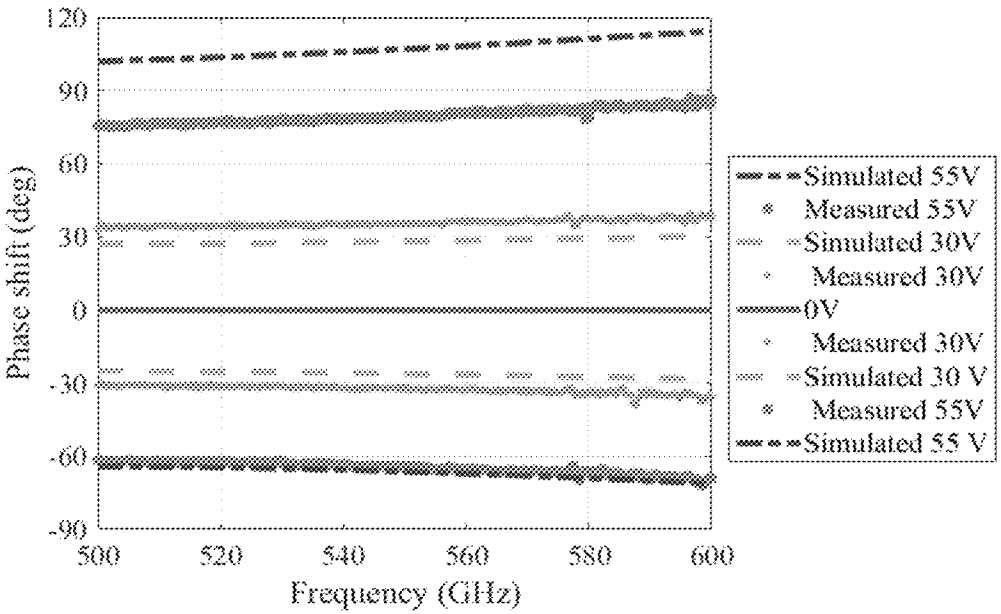
FIG. 12: Measured (dots) and simulations (dashed lines) phase shift over the frequency band 500 600 GHz, for the actuation voltages 30 V and 55 V in both directions.

FIG. 12 shows the measured phase shift over the frequency band 500-600 GHz for different actuated voltages in both directions from 0-55 V. Together with the simulated phase shifts over the same frequency band, the measured MEMS phase shifter displays comparable linearity across the band. The maximum measured phase shift change for a specific position across the band is 21°.

Figure 13:
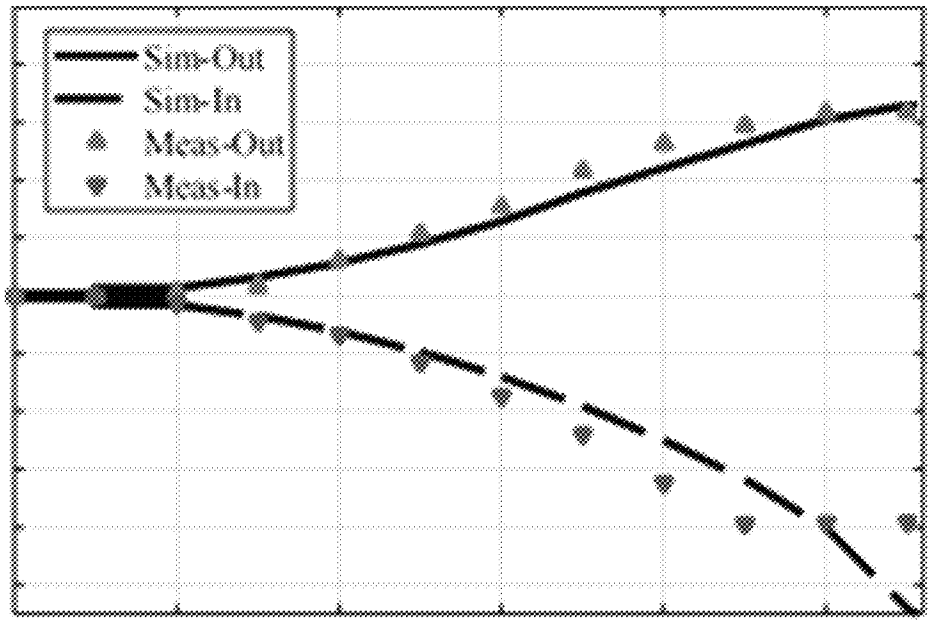
FIG. 13: Measured and simulated phase shift versus applied voltage at 550 GHz, in both directions, starting from the center of the waveguide, which is the passive position of the MEMS actuator. Red up-pointing arrow shows the measured phase shift when the centrally located silicon slab is moving into the waveguide, the blue down-pointing arrows shows the measured phase shift when the silicon slab is moving out of the waveguide. The black lines shows the simulated phase shift while moving into the waveguide (dashed) and out of the waveguide (solid), also seen in FIG. 8A.
Figure 14:
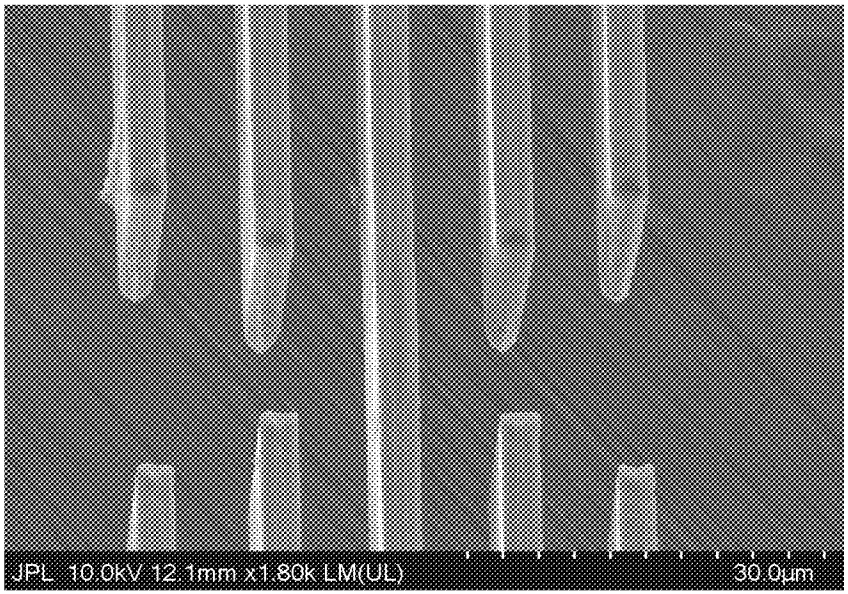
FIG. 14: The SEM image of the spring beams show that the top and bottom of the beams have been etched under the oxide, giving them round features instead of squared corners.

FIG. 13 shows the measured phase shift when the applied voltage is ramped from 0 V to 55 V with steps of 5 V for both directions (in and out of the waveguide) at 550 GHz. The maximum total phase shift was measured to be 145° (compared to the simulated 177° phase shift in FIG. 6). The discrepancy may be due to the fabricated silicon slabs having smaller features than the design. The SEM image in FIG. 14 shows that narrow features such as actuation fingers, honeycomb walls and springs had rounded top and bottom edges, thus increasing the silicon-to-air aspect ratio and thus also reducing the permittivity of the silicon slab.

Simulations show that if the wall thickness of the hexagons (FIG. 2) are reduced by only 1 μm, the maximum phase shift is reduced from 177° down to 161° at 550 GHz. Simulations also show that for every micrometer the thickness of the silicon slab is reduced, the maximum phase shift is lowered by roughly 5°.

The measured phase shift reaches its maximum at around 50 V, while the simulations shows a maximum phase shift at around 56 V, this could be due to the springs being narrower than the design value of 4 μm, thus resulting in a softer spring (eq. 1) and therefore a larger movement for less voltage (eq. 3), can be achieved.

3. Electromechanical Characterization and Reliability

Figure 15:
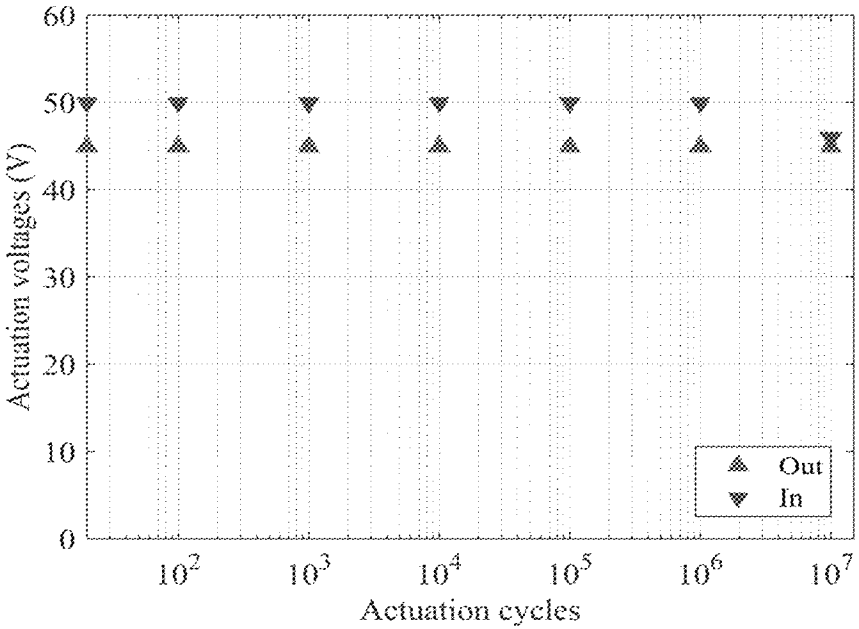
FIG. 15: Lifetime measurement of the MEMS phase shifter. The actuation voltage needed to move the silicon slab fully into the waveguide (red up-arrow) and completely out of the waveguide (blue down-arrow), monitored over 10 million cycles.

FIG. 15 shows the results of the lifetime test of the MEMS phase shifter. The phase shifter was actuated in both directions, alternating between directions with a square-wave at 20 Hz. The block was open during the life time testing and monitored with a microscope camera to check on it between measurements. For each data point, the 20 Hz cycling was stopped and the MEMS phase shifter was connected to a power source, where the actuation voltage in each direction was ramped until the silicon slab was completely outside or fully inserted into the waveguide. This was done optically with a microscope camera and the voltage needed was registered. The measurements show that after 10 million cycles, the voltage needed to fully insert the silicon slab into the waveguide reduced to 46 V (as compared to 50 V before the cycling) probably due to the wear of the springs. The measurements were stopped at 10 million cycles without any fractions of the beam or permanent stiction.

Figure 16:
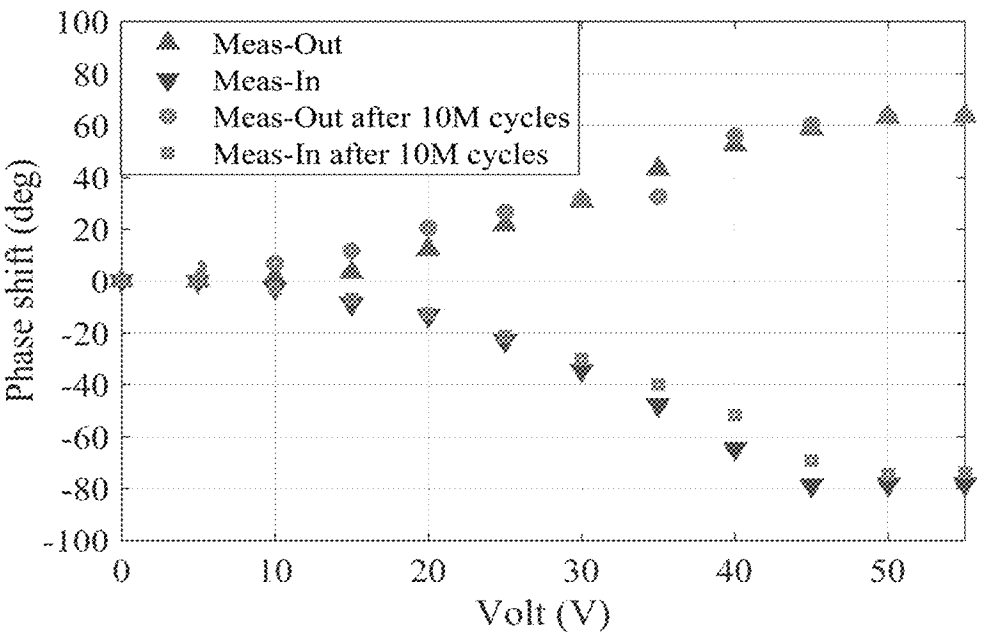
FIG. 16: Measured phase shift versus applied voltage at 550 GHz, in both directions, starting from the center of the waveguide, which is the passive position of the MEMS actuator. The red up-pointing arrows and the blue down-pointing arrows were measured before the lifetime measurements and the green circles and squares were measured after 10 million cycles.

FIG. 16 shows the measured phase shift after 10 million cycles together with the data measured in FIG. 13. The applied voltage was ramped from 0 V to 55 V with steps of 5 V for both directions (in and out of the waveguide) at 550 GHz.

The performance before and after 10 million cycles are comparable, with the later measurements slightly shifted up-ward. This small discrepancy could be due to a shift of the slabs neutral position inside the waveguide. If the slabs neutral position is further in than the center, the reference position is changed. When the slab is moving out of the waveguide there is an anomaly at 35 V which could indicate obstruction of the movement due to particle contamination when performing the lifetime measurements with an open package.

II. ADVANTAGES AND IMPROVEMENTS

Conventional microwave technologies, such as microstrip lines and coplanar waveguides, become too lossy when operating above 100 GHz. While integrated circuit technologies using SiGe and CMOS are most commonly used to fabricate phase shifters at lower frequencies, they cannot operate above 200 GHz due to the high absorption losses of the dielectrics. Instead, waveguides are used for high frequency systems and new silicon micro-fabrication capabilities have enabled the fabrication of MEMS technology at submillimeter wave frequencies.

Illustrative examples described herein use a MEMS motor to move an electromagnetically thin slab having a certain permittivity into the waveguide so as to achieve a delay in the incoming electromagnetic wave that causes a phase shift. The phase shifter enables electronic beam scanning capabilities for submillimeter-wave frequencies.

III. PROCESS STEPS

Figure 17:
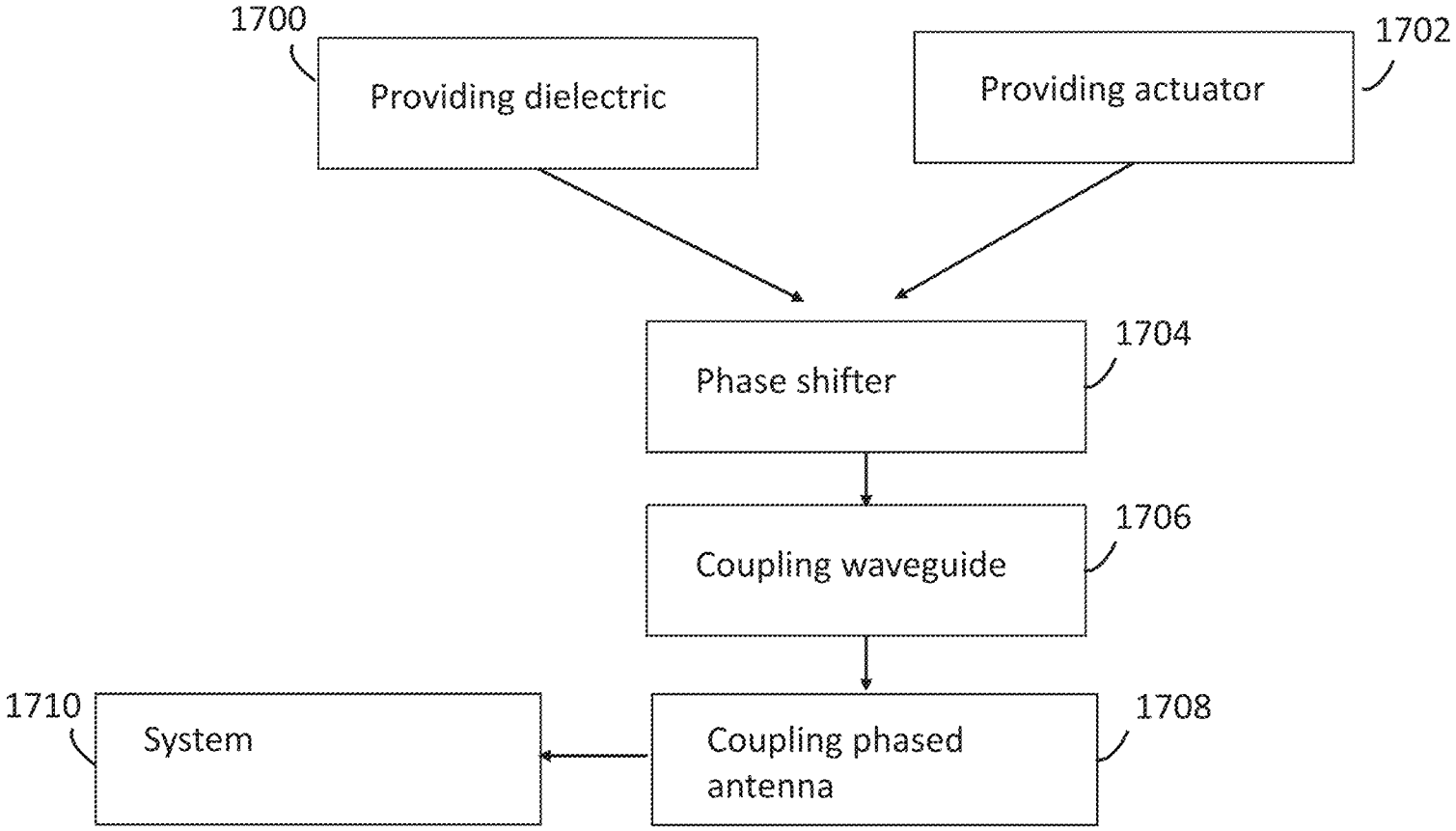
FIG. 17. Flowchart illustrating a method of making a phase shifter and phased array of antennas.

FIG. 17 is a flowchart illustrating a method of making a device. The method comprises the following steps.

Block 1700 represents providing or fabricating a dielectric material.

Block 1702 represents providing or fabricating an actuator and connecting the actuator to the dielectric material. The actuator is configured to move the dielectric material into or out an electromagnetic field so as to shift the phase of the electromagnetic wave.

In one or more examples, steps 1700-1702 comprise (1) providing a silicon wafer 900 including a buried oxide layer 902;

(2) thermally oxidizing the silicon wafer to form a first thermal oxide 904 on a front side of the silicon wafer and second thermal oxide 906 on a back side of the silicon wafer, under conditions to avoid thermal shock to the silicon wafer;

(3) depositing photoresist 950 on the first thermal oxide;

(4) using the photoresist, patterning the first thermal oxide 904 with the pattern 200 and a first side of the actuator 104 structure using photolithography;

(5) etching the pattern 200 of the holes 202 and the first side of the actuator 104 structure in the first thermal oxide 904 using inductively coupled plasma etching;

(6) flipping the silicon wafer 900;

(7) using photoresist, patterning the second thermal oxide 906 with a second side of the actuator 104 structure on an area 952 of the silicon wafer to the side 954 of the pattern of holes;

(8) as shown in FIG. 9(*c*), etching the second side of the actuator 104 structure in the second thermal oxide using inductively coupled plasma etching;

(9) flipping the silicon wafer;

(10) as shown in FIG. 9(*d*), deep reactive ion etching the silicon wafer using the first thermal oxide as a first mask and a first side of the buried oxide layer as an etch stop, to define the pattern of holes 202 and the first side of the actuator structure in the silicon wafer;

(11) as shown in FIG. 9(*e*), deep reactive ion etching the second side of the silicon wafer using the second thermal oxide as a mask and a second side of the buried oxide layer as an etch stop to:

define a cavity 914 behind the pattern of holes in the backside of the silicon wafer, and define the second side of the actuator 104 structure in the backside of the silicon wafer; and

(12) removing the first thermal oxide layer, the second thermal oxide layer, and the exposed buried oxide layer so that the actuator structure comprising an arm connected to the pattern of holes can move (FIG. 9(*f*)).

Block 1704 represents the end result, a device comprising one or more phase shifters each comprising a dielectric material connected to an actuator. The device can be embodied in many ways including, but not limited to, the following.

1. A device, comprising one or more phase shifters 100 each comprising a dielectric material 102; and one or more actuators 104, wherein each of the actuators are connected to one of the dielectric material 102. Each of the actuators are further configured to move the one of the dielectric material 102 into or out an electromagnetic field 406 so as to shift a phase Φ of the electromagnetic wave 406*c* associated with the electromagnetic field interacting with the dielectric material 102.

A first actuation of the phase shifter by the actuator moves the dielectric material towards the electromagnetic wave so that an interaction of the dielectric material with the electromagnetic wave causes a phase shift of the electromagnetic wave. A second actuation of the phase shifter by the actuator moves the dielectric material away from the electromagnetic wave (e.g., reducing or canceling the phase shift).

2. The device of example 1, wherein:

each of the phase shifters 100 comprise the dielectric material 102 including:

an input region 404*a* having a first permittivity $\varepsilon_{t1}$ for the electromagnetic wave 406 incident on the dielectric material 102 through the input region 404*a*; and a second region 402 interfacing with the input region 404*a* and having a second permittivity $\varepsilon_c$ for the electromagnetic wave 406*c* transmitted through the input region 404*a* to the second region 404; and wherein the second permittivity is larger than the first permittivity.

3. The device of example 1, wherein each of the phase shifters 100 comprise the dielectric material 102 including:

an input region 404*a* having a first permittivity $\varepsilon_{t1}$ tailoring an impedance matching of the phase shifter 100 to the waveguide 106;

a second region 402 interfacing with the input region 404*a* and having a second permittivity $\varepsilon_c$ for the electromagnetic wave 406*c* transmitted through the input region 404*a* to the second region 402; and an output region 404*b* interfacing with the second region 402, the output region having a third permittivity $\varepsilon_{t2}$ tailoring an impedance matching of the phase shifter 100 to the waveguide 106 for the electromagnetic wave 406*c* transmitted from the output region and out of the dielectric material and in the waveguide.

4. The device of example 3, wherein the first permittivity tailors the impedance matching so that 3% or less of the power of the electromagnetic wave incident (from the waveguide) on the dielectric material is reflected from the dielectric material.

4b. The device of example 3, wherein the first permittivity tailors the impedance match so that more than 98% of the power of the electromagnetic wave, incident on the dielectric material from the waveguide, is transmitted and less than 2% is reflected back from the dielectric material.

5. The device of example 3, wherein the first permittivity, the second permittivity, and the third permittivity are selected tailor the impedance matching so that reflectivity of the dielectric material for the electromagnetic wave is less than 10% and the degree of phase shifting or the amount of the phase shift is (e.g., any) desired value in a range of 10 degrees to 180 degrees.

6. The device of any of the examples 1-5, wherein:

each of the phase shifters 100 comprises the dielectric material 102 and a pattern 200 of holes 202 in the dielectric material, the holes have a width d and a spacing S, and an aspect ratio comprising the width divided by the spacing is different in the input region 404*a* as compared to in the second region 402 (and optionally also as compared to the output region 402*b*). Example dimensions for d and S include, but are not limited to, 5 micrometers≤d≤500 micrometers, 5 micrometers≤S≤500 micrometers, or such that the aspect ratio is 0.1≤aspect ratio≤0.8. In one or more examples, the aspect ratio is such that the permittivity ε is tuned in a range 1≤ε≤permittivity of the dielectric material. In one or more examples, the dielectric material is silicon (ε=11.9) and the aspect ratio is tuned such that 1≤ε≤11.9. In one or more examples, S is less than a wavelength of the electromagnetic wave. Example patterns and hole shapes/cross-sections include but are not limited to hexagonal, triangular, square, or circular patterns or shapes/cross-section.

7. The device of any of the examples 1-6, wherein the phase shifter comprises a photonic crystal comprising the dielectric material.

8. The device of any of the examples 1-6, wherein phase shifter comprises a second material (e.g., air) embedded in or interfacing with a first material comprising the dielectric material (e.g., silicon) at a plurality of different regions or locations arranged in a lattice, wherein the first material comprises a first dielectric constant different from a second dielectric constant of the second material.

9. The device of any of the examples 1-8, wherein the dielectric material comprises a piece or slab having a rectangular cross-section, a thickness in a range of 100 nanometers (nm)-100 microns, a length of 100 microns-5000 microns, and a width in a range of 50 nm to 500 microns.

10. The device of any of the examples 1-9, wherein the dielectric material comprises or consists essentially of a semiconductor including, but not limited to, silicon.

11. The device of any of the preceding examples 1-10, wherein the dielectric material is etched to structure or form a pattern in the dielectric material, so that the dielectric material has desired impedance matching and phase shifting characteristics or properties.

12. The device of any of the preceding examples 1-11, wherein the actuator comprises a micro-electromechanical system comprising a motor.

13. The device of example 12, wherein the motor comprises a comb drive.

14. The device of example 13, wherein the comb drive uses an electrostatic force acting between two electrically conductive combs to generate a motion that moves the dielectric material into or out of the electromagnetic wave or field. The attractive electrostatic forces are created when a voltage is applied between the combs causing them to be drawn together. The motion generated by the combs is proportional to the change in capacitance between the two combs, increasing with driving voltage, the number of comb teeth, and the gap between the teeth. In one or more examples, the comb drive further includes a restoring spring or restoring lever to restore the comb drive to its original position.

15. The device of any of the examples 1-14, wherein the actuator is formed by etching a structure in a material (e.g., silicon).

Block 1704 represents optionally fabricating and/or coupling one or more waveguides 106 to the one or more phase shifters 100.

Figure 18:
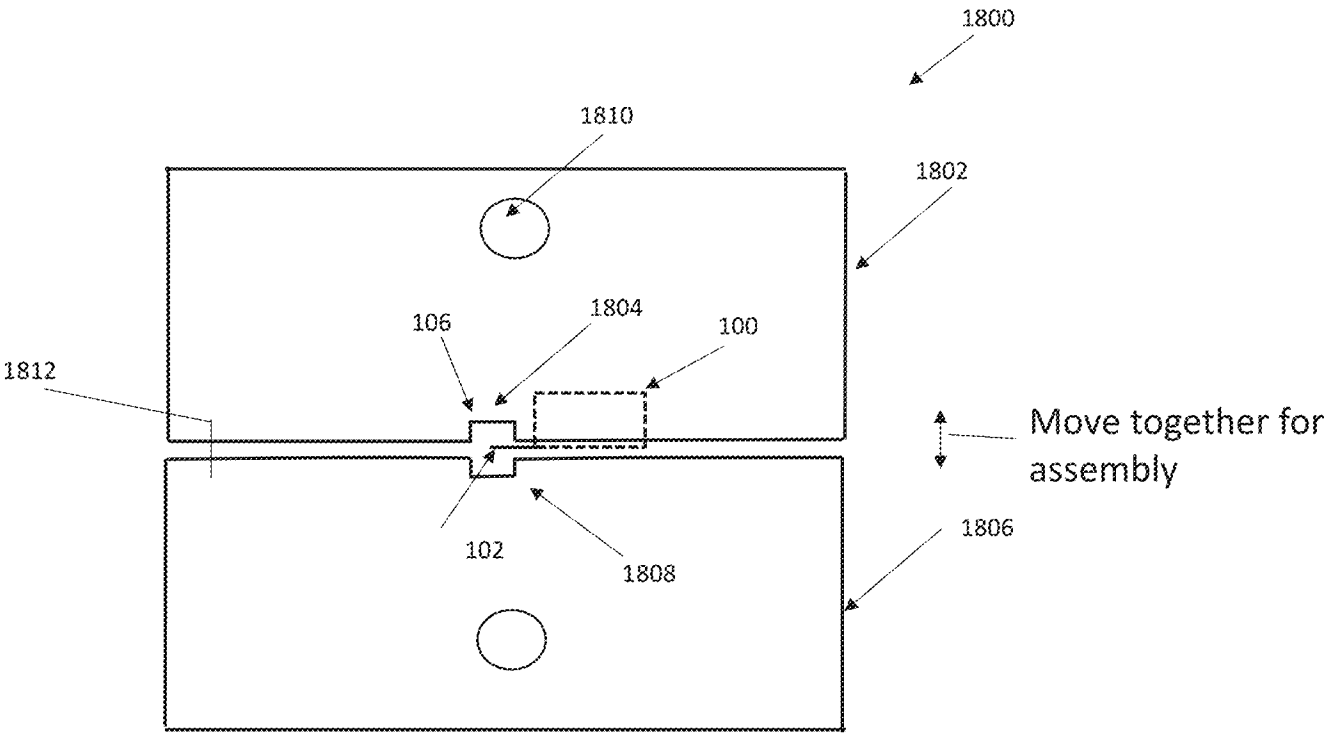
FIG. 18. Schematic illustrating a method of coupling the phase shifters to waveguides.

FIG. 18 illustrates an example of the step, comprising machining a first metal block or wafer 1802 so as to form a first section 1804 of a waveguide 106 in the first (e.g., metal) block or wafer 1802; machining a second (e.g., metal) block or wafer 1806 so as to form a second section 1808 of the waveguide 106 in the second block or wafer 1806; and assembling the phase shifter 100 (comprising actuator 104 and dielectric material 102) between the first block 1802 and the second block 1806 so as to form the waveguide 106 comprising the first section 1804 mating with the second section 1808 and the phase shifter 100 coupled to the waveguide 106, and wherein the waveguide 106 is capable of guiding the electromagnetic wave 406 shifted by the one of the phase shifters 100. Blocks can be assembled together using pins 1812 and to other components through mounting holes 1810 and fasteners.

The waveguide can be embodied in many ways including, but not limited to, the following.

16. A waveguide 106 configured and dimensioned to guide the electromagnetic wave having a frequency of more than 100 gigahertz (GHz) or in a range of 100 GHz to 1000 terahertz (THz).

17. The waveguide of embodiment 16 comprising a hollow waveguide (containing air) having a rectangular cross-section and a conductive (e.g., metal) surface 400.

18. The waveguide of examples 16 or 17 having a width and a height in a range of 100 nm to 1000 micrometers.

19. The device of any of the examples 1-18, comprising a plurality of waveguides, each of the waveguides coupled to one of the phase shifters, and the one of the phase shifters moving (in response to actuation by the actuator) into or out of the electromagnetic wave guided in the waveguide so as to shift the phase of the electromagnetic wave in the waveguide.

20. The device 1800 of any of the examples 1-19, further comprising:

a first block 1802 comprising one or more first sections 1804 of one or more waveguides 106;

a second block 1806 comprising one or more second sections 1808 of the one or more waveguides 106; and the phase shifters 100 between the first block 1802 and the second block 1806 so that one of the first sections mates with one of the second sections to form a waveguide and each of the waveguides 106 are coupled to one of the phase shifters 100.

21. The device of any of the preceding examples 1-20, wherein the electromagnetic wave propagating in the waveguide direction 408 has a first electric field $A_1e^{-i\omega t}$ in the waveguide prior to entering the phase shifter and a second electric field $A_2e^{-i\omega t+\varphi}$ in the waveguide after transmission through and exit from the dielectric material. $A_1$ and $A_2$ represent magnitudes of the electric fields and the phase shift caused or imparted by transmission the dielectric material is $\varphi$. In one or more examples, the dielectric material is patterned or structured so that $(A_2/A_1)^2$ is at least 0.75 and $\varphi$ is a desired value in a range of $0 \leq \varphi \leq 180$ degrees.

Block 1706 represents optionally coupling each of the waveguides to an antenna in a phased array antenna system. The system can be embodied in many ways including, but not limited to, the following.

Figure 19B:
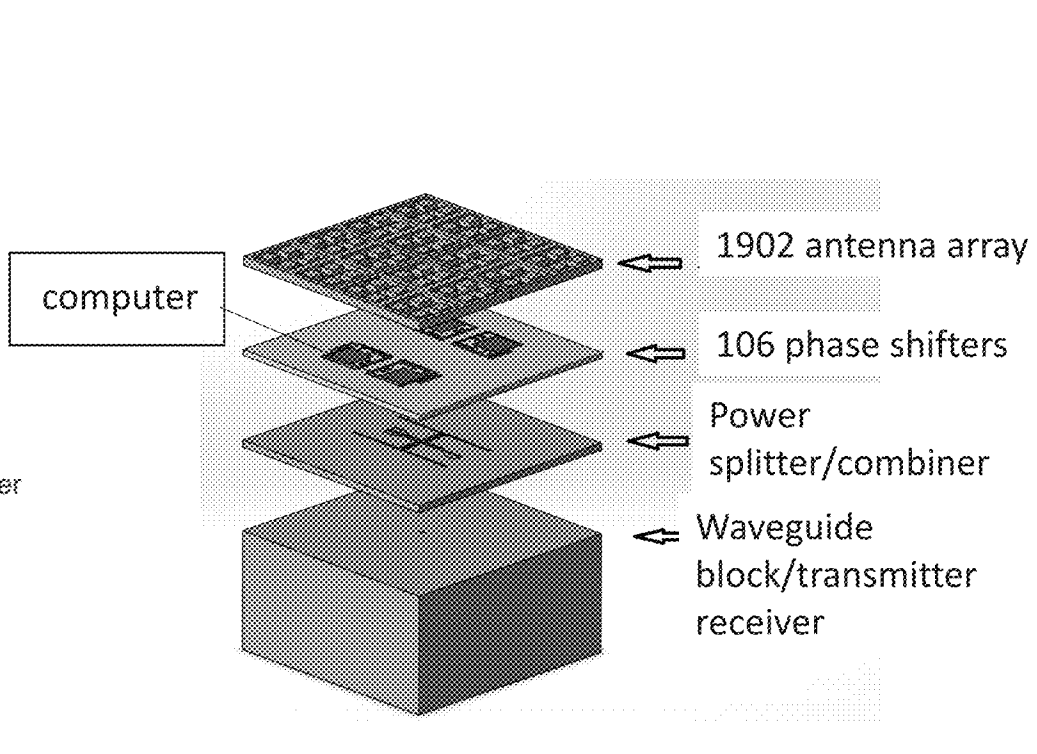
FIG. 19A and FIG. 19B. Schematics of the phase shifters assembled with a phased array of antennas.
Figure 19A:
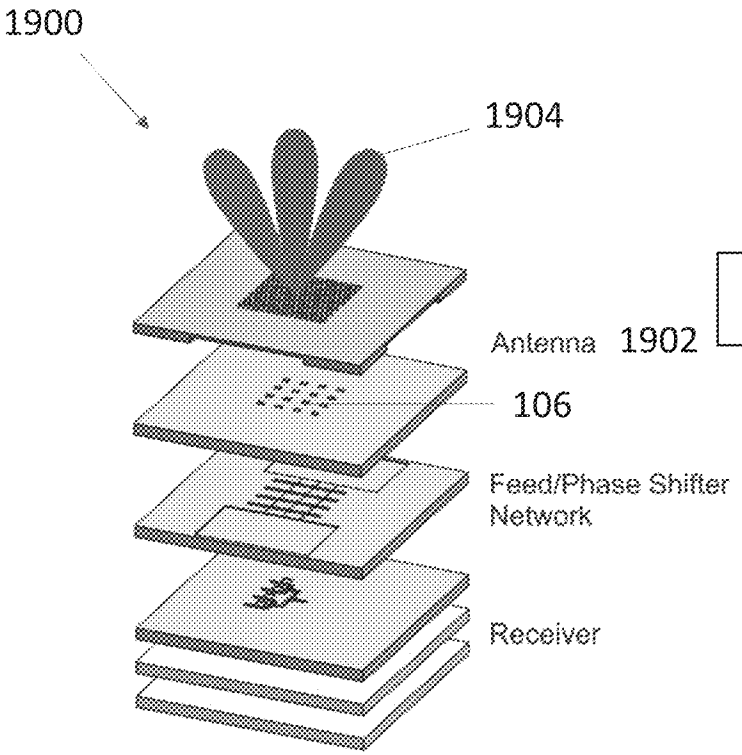

22. A phased array antenna system. FIGS. 19A and 19B illustrate example phased array antenna systems 1900 comprising a plurality of antennas 1902 emitting electromagnetic radiation 1904; and a plurality of waveguides 106, each of the waveguides feeding one of the plurality of antennas with the electromagnetic fields generating the electromagnetic radiation emitted from the antennas. Each of the waveguides are further coupled to one of the phase shifters 100 so that the actuator moves one of the dielectric material into the electromagnetic wave guided by the waveguide coupled to the one of the phase shifters. The electromagnetic waves having different phases cause destructive or constructive interference of the radiation that controls the directivity of the antenna.

Block 1708 represents optionally including the phased antenna array or the one or more phase shifters in a system or application.

The system can be embodied in many ways including, but not limited to, the following.

23. A computer controlling the actuators so as to independently move each of the phase shifters comprising different permittivities and/or by different amounts, thereby shifting the phase of the electromagnetic waves in each of the waveguides by different amounts and steering a beam of the electromagnetic radiation outputted from the antennas.

24. The system of example 23, wherein the computer controls the actuators with a digital signal so that the phase shifters digitally shift the phases electromagnetic waves according to the digital signal.

25. The system of example 23, wherein the computer controls the actuators with an analog signal so that the phase shifters shift the phases electromagnetic waves according to the analog signal.

26. A remote sensing system comprising the system of any of the examples 22-25, wherein the electromagnetic radiation is used to perform remote sensing.

27. A communications system comprising the system of any of the examples 22-25, wherein the electromagnetic radiation transmits a signal.

28. An electronic or electronically controlled beam scanner comprising the system of any of the examples 22-25.

IV. REFERENCES

The following references are incorporated by reference herein.

[1] S. Barker and G. Rebeiz, "Distributed MEMS true-time delay phase shifters and wide-band switches," IEEE Transactions on Microwave Theory and Techniques, vol. 46, no. 11, pp. 1881-1890, 1998. [Online]. Available: http://ieeexplore.ieee.org/document/734503/

[2] J. Hayden and G. Rebeiz, "2-bit MEMS distributed X-band phase shifters," IEEE Microwave and Guided Wave Letters, vol. 10, no. 12, pp. 540-542, December 2000. [Online]. Available: http://ieeexplore.ieee.org/document/895096/

[3] J. Lampen, S. Majumder, C. Ji, and J. Maciel, "Low-loss, MEMS based, broadband phase shifters," IEEE International Symposium on Phased Array Systems and Technology, pp. 219-224, 2010.

[4] M. Bakri-Kassem, R. Mansour, and S. Safavi-Naeini, "Novel millimeter-wave slow-wave phase shifter using MEMS technology," European Microwave Week 2011:

"Wave to the Future", EuMW 2011, Conference Proceedings—6th European Microwave Integrated Circuit Conference, EuMIC 2011, no. October, pp. 518-521, 2011.

[5] M. Jost, R. Reese, C. Weickhmann, C. Schuster, O. H. Karabey, H. Maune, and R. Jakoby, "Tunable dielectric delay line phase shifter based on liquid crystal technology for a SPDT in a radiometer calibration scheme at 100 GHz," in 2016 IEEE MTT-S International Microwave Symposium (IMS). San Francisco: IEEE, May 2016, pp. 1-4. [Online]. Available: http://ieeexplore.ieee.org/document/7540007/

[6] U. Shah, E. Decrossas, C. Jung-Kubiak, T. Reck, G. Chattopadhyay, I. Mehdi, and J. Oberhammer, "Submillimeter-Wave 3.3-bit RF MEMS Phase Shifter Integrated in Micromachined Waveguide," IEEE Transactions on Terahertz Science and Technology, pp. 1-10, 2016. [Online]. Available: http://ieeexplore.ieee.org/document/7513394/

[7] T. Reck, C. Jung-Kubiak, and G. Chattopadhyay, "A 700-GHz MEMS Waveguide Switch," IEEE Transactions on Terahertz Science and Technology, vol. 6, no. 4, pp. 641-643, 2016.

[8] J. Grade, H. Jerman, and T. Kenny, "Design of large deflection electrostatic actuators," Journal of Microelectromechanical Systems, vol. 12, no. 3, pp. 335-343, June 2003. [Online]. Available: http://ieeexplore.ieee.org/document/1203772/

CONCLUSION

This concludes the description of the preferred embodiment of the present invention. The foregoing description of one or more embodiments of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A device, comprising:

at least one phase shifter comprising:

a dielectric material comprising a pattern of holes; and an actuator connected to the dielectric material, the actuator comprising a micro-electromechanical system comprising a motor; and wherein:

a first actuation of the at least one phase shifter by the actuator moves the dielectric material towards an electromagnetic wave so that an interaction of the dielectric material with the electromagnetic wave causes a phase shift of the electromagnetic wave, and a second actuation of the at least one phase shifter by the actuator moves the dielectric material away from the electromagnetic wave.

2. The device of claim 1, wherein the dielectric material comprises:

an input region having a first permittivity for the electromagnetic wave incident on the dielectric material through the input region;

a transmission region interfacing with the input region and having a second permittivity for the electromagnetic wave transmitted through the input region to the second region; and wherein the second permittivity is larger than the first permittivity.

3. The device of claim 1, wherein the dielectric material comprises:

an input region having a first permittivity tailoring an impedance match of the dielectric material to a waveguide guiding the electromagnetic wave;

a transmission region interfacing with the input region and having a second permittivity for the electromagnetic wave transmitted through the input region to the transmission region; and an output region interfacing with the transmission region, the output region tailoring an impedance match of the dielectric material to the waveguide for the electromagnetic wave transmitted from the transmission region and through the output region to the waveguide.

4. The device of claim 3, wherein the first permittivity tailors the impedance match so that 3% or less of the power of electromagnetic wave incident on the dielectric material is reflected from the dielectric material.

5. The device of claim 3, wherein:

the at least one phase shifter comprises the dielectric material and the pattern of holes in the dielectric material, the holes have a width and a spacing, and an aspect ratio comprising the width divided by the spacing is different in the input region as compared to in the transmission region.

6. The device of claim 1, further comprising:

a waveguide configured and dimensioned to guide the electromagnetic wave having a frequency in a range of 100 gigahertz (GHz) to 1000 terahertz (THz), wherein:

the first actuation moves the dielectric material into the waveguide, and the second actuation moves the dielectric material out of the waveguide.

7. The device of claim 6, wherein the waveguide comprises a hollow waveguide having a rectangular cross-section and a metal surface.

8. The device of claim 1, further comprising:

a first block comprising one or more first sections of one or more waveguides;

a second block comprising one or more second sections of the one or more waveguides; and the at least one phase shifter between the first block and the second block such that each of the first sections mate with one of the second sections to form one of the waveguides guiding the electromagnetic wave and each of the waveguides are coupled to one of the phase shifters.

9. The device of claim 1, wherein the actuator comprises a comb drive.

10. The device of claim 1, further comprising:

a phased array antenna system comprising a plurality of antennas;

a plurality of the at least one phase shifter;

a plurality of the at least one actuator;

a plurality of waveguides, each of the waveguides:

feeding one of the plurality of antennas with the electromagnetic wave so as to generate an output electromagnetic wave; and coupled to one of the phase shifters so that each of the actuators moves one of the phase shifters into the electromagnetic wave guided by the waveguide coupled to the one of the phase shifters.

11. The device of claim 10, further comprising a plurality of the actuators and a computer controlling the actuators so as to independently move each of the phase shifters, each of the phase shifters comprising a different permittivity and/or moved by different amounts, thereby shifting the phase of the electromagnetic wave in each of the waveguides by different amounts so as to steer a beam of electromagnetic radiation outputted from the antennas.

12. The device of claim 11, wherein the computer controls the actuators with a digital signal so that the phase shifters digitally shift the phase of the electromagnetic waves according to the digital signal.

13. The device of claim 11, wherein the computer controls the actuators with an analog signal so that the phase shifters shift the phase of the electromagnetic waves according to the analog signal.

14. A remote sensing system comprising the device of claim 10, wherein the electromagnetic radiation is used to perform remote sensing.

15. A communications system comprising the device of claim 10, wherein the electromagnetic radiation transmits a signal.

16. A method of making a device, comprising:

etching a dielectric material with a pattern of holes; and providing at least one actuator connected to the dielectric material, forming a phase shifter, wherein the actuator is configured to move the dielectric material towards or away from an electromagnetic wave so as to shift a phase of the electromagnetic wave interacting with the dielectric material.

17. The method of claim 16, wherein providing the actuator comprises etching a micro-electromechanical system structure in a wafer.

18. The method of claim 16, wherein the providing comprises:

providing a silicon wafer including a buried oxide layer;

thermally oxidizing the silicon wafer to form a first thermal oxide on a front side of the silicon wafer and second thermal oxide on a back side of the silicon wafer, under conditions to avoid thermal shock to the silicon wafer;

depositing photoresist on the first thermal oxide;

patterning the first thermal oxide with the pattern and a first side of the actuator structure using photolithography and the photoresist;

etching the pattern of the holes and the first side of the actuator structure in the first thermal oxide using inductively coupled plasma etching;

patterning the second thermal oxide with a second side of the actuator structure on an area of the silicon wafer to the side of the pattern of holes;

etching the second side of the actuator structure in the second thermal oxide using inductively coupled plasma etching;

deep reactive ion etching the silicon wafer using the first thermal oxide as a first mask and a first side of the buried oxide layer as an etch stop, to define the pattern of holes and the first side of the actuator structure in the silicon wafer;

deep reactive ion etching the second side of the silicon wafer using the second thermal oxide as a mask and the buried oxide layer as an etch stop to:

define a cavity behind the pattern of holes in the backside of the silicon wafer, and define the second side of the actuator structure in the backside of the silicon wafer; and removing the first thermal oxide layer, the second thermal oxide layer, and the exposed buried oxide layer so that the actuator structure comprising an arm connected to the pattern of holes can move.

19. The method of claim 16, further comprising:

machining a first metal block so as to form a first section of a waveguide in the first metal block;

machining a second metal block so as to form a second section of the waveguide in the second block; and assembling the phase shifter between the first metal block and the second metal block so as to form the waveguide comprising the first section mating with the second section and the phase shifter coupled to the waveguide guiding the electromagnetic wave.

20. The method of claim 16, wherein the dielectric material comprises:

an input region having a first permittivity for the electromagnetic wave incident on the dielectric material through the input region;

a transmission region interfacing with the input region and having a second permittivity for the electromagnetic wave transmitted through the input region to the second region; and wherein the second permittivity is larger than the first permittivity.

21. A device, comprising:

at least one phase shifter comprising:

a dielectric material; and an actuator connected to the dielectric material, the actuator comprising a micro-electromechanical system comprising a motor etched in a wafer; and wherein:

a first actuation of the at least one phase shifter by the actuator moves the dielectric material towards an electromagnetic wave so that an interaction of the dielectric material with the electromagnetic wave causes a phase shift of the electromagnetic wave, and a second actuation of the at least one phase shifter by the actuator moves the dielectric material away from the electromagnetic wave.

* * * * *